US010477309B2

(12) United States Patent
Mitsufuji

(10) Patent No.: US 10,477,309 B2
(45) Date of Patent: Nov. 12, 2019

(54) SOUND FIELD REPRODUCTION DEVICE, SOUND FIELD REPRODUCTION METHOD, AND PROGRAM

(71) Applicant: Sony Corporation, Tokyo (JP)

(72) Inventor: Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/302,468

(22) PCT Filed: Apr. 3, 2015

(86) PCT No.: PCT/JP2015/060554
§ 371 (c)(1),
(2) Date: Oct. 6, 2016

(87) PCT Pub. No.: WO2015/159731
PCT Pub. Date: Oct. 22, 2015

(65) Prior Publication Data

US 2017/0034620 A1 Feb. 2, 2017

(30) Foreign Application Priority Data

Apr. 16, 2014 (JP) ..... 2014-084290

(51) Int. Cl.
*H04R 3/00* (2006.01)
*H04S 7/00* (2006.01)
(Continued)

(52) U.S. Cl.
CPC ..... *H04R 3/005* (2013.01); *G10L 21/028* (2013.01); *G10L 21/0272* (2013.01);
(Continued)

(58) Field of Classification Search
CPC .... H04R 3/005; H04R 3/12; H04R 2201/403; H04R 2430/20; G10L 21/0272;
(Continued)

(56) References Cited

U.S. PATENT DOCUMENTS 9,380,398 B2 6/2016 Mitsufuji
10,015,615 B2 7/2018 Mitsufuji et al.
(Continued)

FOREIGN PATENT DOCUMENTS

EP 1971183 A1 9/2008
JP 2008-118559 A 5/2008
(Continued)

OTHER PUBLICATIONS

Koyama et al., Design of Transform Filter for Sound Field Reproduction Using Microphone Array and Loudspeaker Array, 2011 IEEE Workshop on Applications of Signal Processing to Audio and Acoustics, Oct. 16-19, 2011, New Paltz, NY, 4 pages.
(Continued)

*Primary Examiner* — William A Jerez Lora
(74) *Attorney, Agent, or Firm* — Wolf, Greenfield & Sacks, P.C.

(57) ABSTRACT

The present technique relates to a sound field reproduction device, a sound field reproduction method, and a program that make it possible to further accurately reproduce a certain sound field.

A feature amount extraction unit extracts a main sound source feature amount from a sound pickup signal obtained by picking up a sound from a main sound source. A main sound source separation unit separates the sound pickup signal obtained through the sound pickup with a microphone array that mainly picks up a sound from the main sound source into a main sound source component and an auxiliary sound source component using the main sound source feature amount. On the basis of the main sound source component and the auxiliary sound source component that have been separated, a main sound source emphasis unit generates a signal in which the main sound source components are emphasized. A drive signal for a speaker array is
(Continued)

generated from the signal generated in this manner and supplied to the speaker array. The present technique can be applied to a sound field reproduction apparatus.

13 Claims, 7 Drawing Sheets

(51) Int. Cl.
*G10L 21/0272* (2013.01)
*G10L 21/028* (2013.01)
*G10L 21/0308* (2013.01)
*H04R 3/12* (2006.01)

(52) U.S. Cl.
CPC ..... *G10L 21/0308* (2013.01); *H04R 3/12* (2013.01); *H04S 7/30* (2013.01); *H04R 2201/403* (2013.01); *H04R 2430/20* (2013.01); *H04S 2400/15* (2013.01); *H04S 2420/13* (2013.01)

(58) Field of Classification Search
CPC ..... G10L 21/028; G10L 21/0308; H04S 2400/15; H04S 2420/13; H04S 7/30
USPC ..... 381/26, 91, 92, 95
See application file for complete search history.

(56) References Cited

U.S. PATENT DOCUMENTS

2007/0223731 A1* 9/2007 Togami ..... H04R 3/005 381/92
2009/0052688 A1 2/2009 Ishibashi et al.
2011/0307251 A1* 12/2011 Tashev ..... G10L 21/028 704/231
2012/0114138 A1* 5/2012 Hyun ..... H04R 3/005 381/92
2013/0029684 A1* 1/2013 Kawaguchi ..... H04R 3/005 455/456.1
2014/0321653 A1 10/2014 Mitsufuji
2015/0066486 A1* 3/2015 Kokkinis ..... G10L 19/008 704/203
2016/0269848 A1 9/2016 Mitsufuji et al.
2018/0075837 A1 3/2018 Maeno et al.
2018/0249244 A1 8/2018 Maeno et al.
2018/0279042 A1 9/2018 Mitsufuji
2018/0359594 A1 12/2018 Maeno et al.

FOREIGN PATENT DOCUMENTS

JP 2009-025490 A 2/2009
JP 2014-007543 A 1/2014
WO WO 2007/058130 A1 5/2007

OTHER PUBLICATIONS

Li et al., Capture and Recreation of Higher Order 3D Sound Fields Via Reciprocity, Proceedings of ICAD 04—Tenth Meeting of the International Conference on Auditory Display, Sydney, Australia, Jul. 6-9, 2004, 8 pages.
International Search Report and Written Opinion and English translation thereof dated May 19, 2015 in connection with International Application No. PCT/JP2015/060554.
International Preliminary Report on Patentability and English translation thereof dated Oct. 27, 2016 in connection with International Application No. PCT/JP2015/060554.

* cited by examiner

SOUND FIELD REPRODUCTION DEVICE, SOUND FIELD REPRODUCTION METHOD, AND PROGRAM

CROSS REFERENCE TO RELATED APPLICATIONS

This application claims the benefit under 35 U.S.C. § 371 as a U.S. National Stage Entry of International Application No. PCT/JP2015/060554, filed in the Japanese Patent Office as a Receiving Office on Apr. 3, 2015, which claims priority to Japanese Patent Application Number JP2014-084290, filed in the Japanese Patent Office on Apr. 16, 2014, each of which is hereby incorporated by reference in its entirety.

TECHNICAL FIELD

The present technique relates to a sound field reproduction device, a sound field reproduction method, and a program. In particular, the present technique relates to a sound field reproduction device, a sound field reproduction method, and a program configured to be capable of further accurately reproducing a certain sound field.

BACKGROUND ART

In the past, a wave field synthesis technique has been known in which a sound is picked up on a wave surface of the sound in a sound field using a plurality of microphones to reproduce the sound field on the basis of a sound pickup signal that has been obtained.

For example, in a case where a sound field within a closed space is required to be accurately reproduced, it is possible to reproduce the sound field according to Kirchhoff-Helmholtz theory in which sound pressure at a boundary surface of the closed space and sound pressure gradients at all coordinates within the closed space are recorded and then, sounds are played back at corresponding coordinates using a sounding body having a dipole property and a sounding body having a monopole property.

In a real environment, a microphone and a speaker are used to record and play back the sound field. Typically, a simple pair of a microphone for sound pressure and a monopole speaker is used due to physical restriction. In this case, a difference is generated between a played-back sound field and an actual sound field because of a lack of sound pressure gradients.

As a representative example where such a difference is generated, a case is given in which a signal arriving from a sound source at the outside of the closed space and a signal arriving from the inside of the closed space due to another sound source at the outside of the closed space by passing through the interior of the closed space are mixed when recorded. As a result, in this example, the two sound sources are heard from unexpected positions during playback. In other words, positions of the sound sources perceived by a user hearing the sound field are set at positions different from original positions at which the sound sources should be located.

This phenomenon is caused by a signal that has been originally canceled out in a physical manner in a listening area corresponding to the closed space is maintained due to a lack of acquiring the sound pressure gradients.

Therefore, for example, a technique has been proposed in which a microphone is arranged at a surface of a rigid body to make the sound pressure gradient zero, thereby solving the occurrence of the aforementioned phenomenon (for example, refer to Non-patent Document 1).

In addition, another technique has been also proposed in which the boundary surface of the closed space is limited to a flat surface or a straight line to exclude the influence of the signal arriving from the inside of the boundary surface, thereby preventing the aforementioned phenomenon from occurring (for example, refer to Non-patent Document 2).

CITATION LIST

Non-Patent Document

Non-patent Document 1: Zhiyun Li, Ramani Duraiswami, Nail A. Gumerov, "Capture and Recreation of Higher Order 3D Sound Fields via Reciprocity", in Proceedings of ICAD 04-Tenth Meeting of the International Conference on Auditory Display, Sydney, Australia, Jul. 6-9, 2004.

Non-patent Document 2: Shoichi Koyama et al., "Design of Transform Filter for Sound Field Reproduction using Micorphone Array and Loudspeaker Array", IEEE Workshop on Applications of Signal Processing to Audio and Acoustics 2011

SUMMARY OF THE INVENTION

Problems to be Solved by the Invention

In the techniques described above, however, it has been difficult to accurately reproduce a certain sound field.

For example, because a range of the sound field for which the sound pickup is required is proportional to a cubic volume of the rigid body, the technique disclosed in Non-patent Document 1 is not suitable for recording a wide-range sound field.

Meanwhile, in the technique disclosed in Non-patent Document 2, the installation of a microphone array used for the sound pickup in the sound field is limited to a place where the coming round of sound does not often occur, for example, near a wall.

The present technique has been made taking such situation into consideration, and an object thereof is to enable further accurate reproduction of a certain sound field.

Solutions to Problems

A sound field reproduction device according to an aspect of the present technique includes an emphasis unit that emphasizes main sound source components of a first sound pickup signal obtained by picking up a sound using a first microphone array positioned ahead of a main sound source, on the basis of a feature amount extracted from a signal obtained by picking up a sound from the main sound source using a sound pickup unit.

The sound field reproduction device can be further provided with a reduction unit that reduces the main sound source components of a second sound pickup signal obtained by picking up a sound using a second microphone array positioned ahead of an auxiliary sound source, on the basis of the feature amount.

The emphasis unit is capable of separating the first sound pickup signal into the main sound source component and an auxiliary sound source component on the basis of the feature amount and emphasizing the separated main sound source components.

The reduction unit is capable of separating the second sound pickup signal into the main sound source component and the auxiliary sound source component on the basis of the feature amount and emphasizing the separated auxiliary sound source components to reduce the main sound source components of the second sound pickup signal.

The emphasis unit is capable of separating the first sound pickup signal into the main sound source component and the auxiliary sound source component using nonnegative tensor factorization.

The reduction unit is capable of separating the second sound pickup signal into the main sound source component and the auxiliary sound source component using the nonnegative tensor factorization.

The sound field reproduction device can be provided with the plurality of emphasis units, each of which corresponds to each of the plurality of first microphone arrays.

The sound field reproduction device can be provided with the plurality of reduction units, each of which corresponds to each of the plurality of second microphone arrays.

The first microphone array can be arranged on a straight line connecting a space enclosed by the first microphone array and the second microphone array and the main sound source.

The sound pickup unit can be arranged in the vicinity of the main sound source.

A sound field reproduction method or a program according to another aspect of the present technique includes a step of emphasizing main sound source components of a first sound pickup signal obtained by picking up a sound using a first microphone array positioned ahead of a main sound source, on the basis of a feature amount extracted from a signal obtained by picking up a sound from the main sound source using a sound pickup unit.

According to an aspect of the present technique, main sound source components of a first sound pickup signal obtained by picking up a sound using a first microphone array positioned ahead of a main sound source are emphasized on the basis of a feature amount extracted from a signal obtained by picking up a sound from the main sound source using a sound pickup unit.

Effects of the Invention

According to an aspect of the present technique, a certain sound field can be further accurately reproduced.

Note that, the effects described herein are not necessarily limited and any effects described in the present disclosure may be applied.

MODE FOR CARRYING OUT THE INVENTION

Hereinafter, embodiments to which the present technique is applied will be described with reference to the drawings.

First Embodiment

<About Present Technique>

The present technique is configured to record a sound field in a real space (sound pickup space) using a plurality of linear microphone arrays, each of which is constituted by a plurality of microphones placed in order on a straight line and, on the basis of a sound pickup signal obtained as a result thereof, reproduce the sound field using a plurality of linear speaker arrays, each of which is constituted by a plurality of speakers arranged on a straight line. At this time, a sound based on the sound pickup signal is played back such that an equivalent sound field is obtained between a reproduction space (listening area) where the sound field is reproduced and the sound pickup space.

Hereinafter, it is assumed that a sound source serving as an object for which sound pickup is mainly required is called a main sound source and the other sound sources are called auxiliary sound sources. Note that the plurality of main sound sources may be employed.

Figure 1:
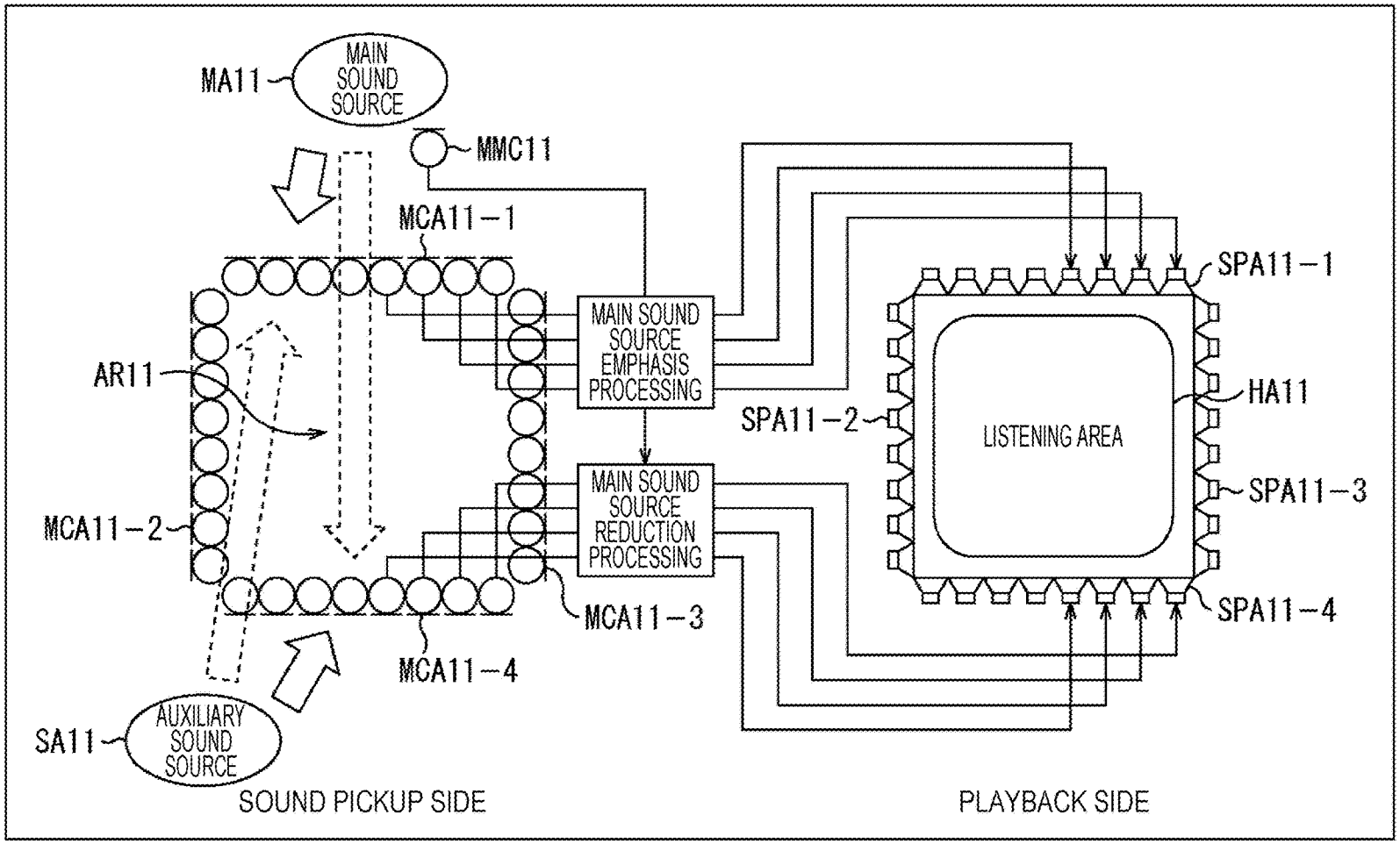
FIG. 1 is a diagram for describing the present technique.

According to the present technique, for example, three types of sound pickup units are used to pick up a sound in the sound pickup space as described in FIG. 1.

The example illustrated in FIG. 1 represents a system in which both of the linear microphone arrays and the linear speaker arrays are arranged on four sides so as to form squares, whereby a sound field generated from a sound source present at the outside of a closed space enclosed by the linear microphone arrays is reproduced at the inside of a closed space enclosed by the linear speaker arrays (listening area).

Specifically, as illustrated on the left side of FIG. 1, a main sound source MA11 serving as a sound source of a sound to be mainly picked up and an auxiliary sound source SA11 serving as a sound source of a sound not to be mainly picked up are present in the sound pickup space.

In this state, sounds from this main sound source MA11 and this auxiliary sound source SA11 are picked up using a microphone MMC11 and a linear microphone array MCA11-1 to a linear microphone array MCA11-4. At this time, the sound from the auxiliary sound source arrives to each of the linear microphone arrays from a direction different from that of the sound from the main sound source.

The microphone MMC11 is constituted by a single microphone or a plurality of microphones, alternatively, a microphone array arranged at a position in proximity to the main sound source MA11 and picks up the sound from the main sound source MA11. The microphone MMC11 is arranged at a position closest to the main sound source MA11 among the sound pickup units arranged in the sound pickup space.

In particular, the microphone MMC11 is arranged in the vicinity of the main sound source MA11 such that the sound from the main sound source MA11 is picked up at a large volume enough to be able to ignore the sound from the auxiliary sound source SA11 while the sound is picked up in the sound field.

Note that, the following description will continue by assuming that the microphone MMC11 is constituted by a single microphone.

Meanwhile, the linear microphone array MCA11-1 to the linear microphone array MCA11-4 are arranged on four sides in the sound pickup space so as to form a square, where a square region AR11 enclosed by the linear microphone array MCA11-1 to the linear microphone array MCA11-4 serves as a region corresponding to a listening area HA11 in the reproduction space illustrated on the right side in FIG. 1. The listening area HA11 is a region in which a listener hears a reproduced sound field.

In this example, the linear microphone array MCA11-1 is arranged at the front (ahead) of the main sound source MA11, while the linear microphone array MCA11-4 is arranged at the front (ahead) of the auxiliary sound source SA11. Note that, it is assumed hereinafter that the linear microphone array MCA11-1 to the linear microphone array MCA11-4 are also referred to simply as linear microphone arrays MCA11 when it is not necessary to particularly distinguish these linear microphone arrays from one another.

In the sound pickup space, some of these linear microphone arrays MCA11 are set as main sound source linear microphone arrays that mainly pick up the sound from the main sound source MA11, whereas the other linear microphone arrays are set as auxiliary sound source linear microphone arrays that mainly pick up the sound from the auxiliary sound source SA11.

Figure 2:
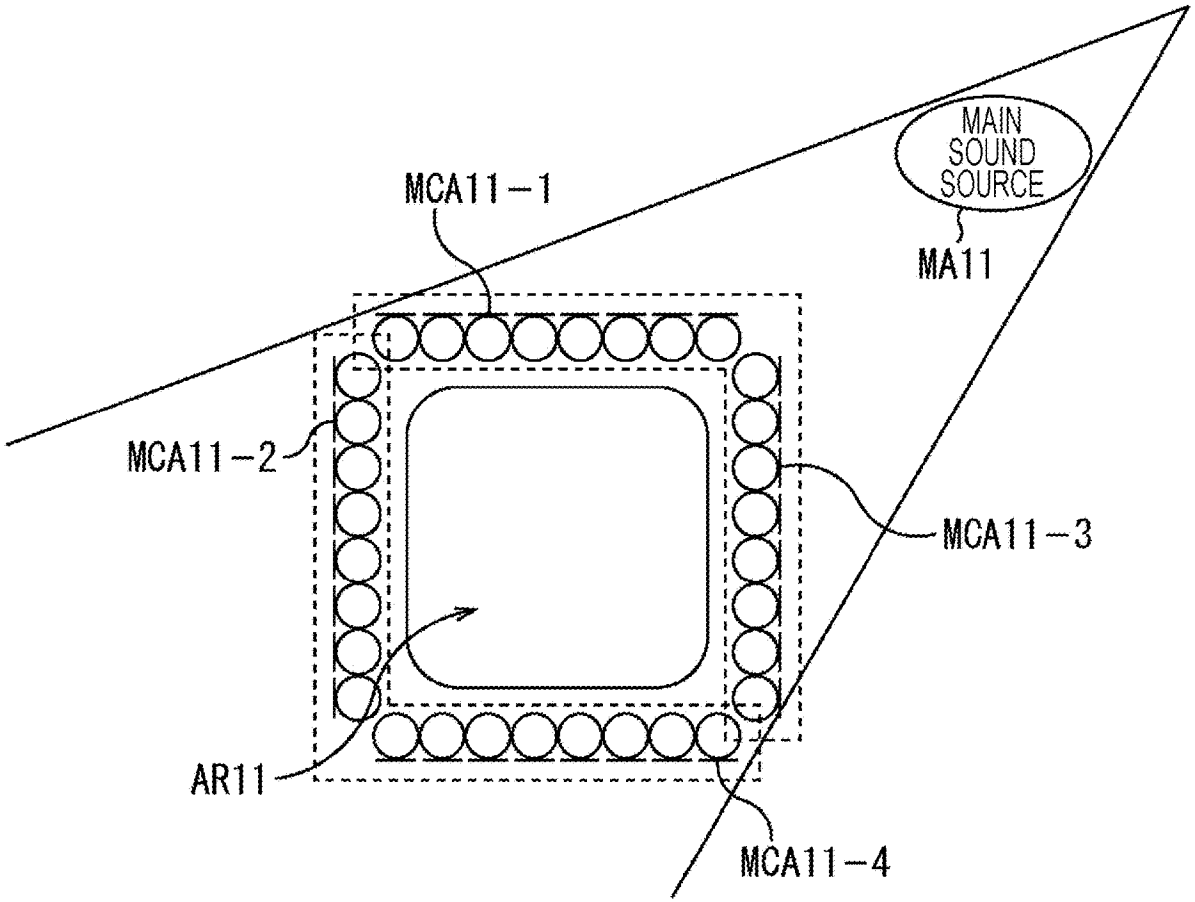
FIG. 2 is a diagram for describing a main sound source linear microphone array and an auxiliary sound source linear microphone array.

For example, the main sound source linear microphone arrays and the auxiliary sound source linear microphone arrays are specifically determined as illustrated in FIG. 2. Note that, in FIG. 2, constituent members corresponding to those in the case of FIG. 1 are denoted with the same reference numerals and the description thereof will be omitted as appropriate. For the purpose of description, however, the position of the main sound source MA11 relative to the respective linear microphone arrays MCA11 in FIG. 2 is arranged at a position different from that in the case of FIG. 1.

In the example in FIG. 2, the linear microphone array MCA11 located between the main sound source MA11 and the region AR11 corresponding to the listening area HA11 is set as the main sound source linear microphone array. Accordingly, the linear microphone array MCA11 arranged on a straight line connecting the main sound source MA11 and an arbitrary position in the region AR11 is set as the main sound source linear microphone array.

In addition, among the linear microphone arrays MCA11, the linear microphone array MCA11 other than the main sound source linear microphone array is set as the auxiliary sound source linear microphone array.

In other words, when the main sound source MA11 is likened to a light source, the linear microphone array MCA11 irradiated with light emitting from the main sound source MA11 is set as the main sound source linear microphone array.

Meanwhile, the linear microphone array MCA11 located behind the main sound source linear microphone array and not irradiated with the light emitting from the main sound source MA11, namely, the linear microphone array MCA11 covered by the main sound source linear microphone array and invisible when viewed from the main sound source MA11 is set as the auxiliary sound source linear microphone array.

Consequently, in FIG. 2, the linear microphone array MCA11-1 and the linear microphone array MCA11-3 are set as the main sound source linear microphone arrays, whereas the linear microphone array MCA11-2 and the linear microphone array MCA11-4 are set as the auxiliary sound source linear microphone arrays.

Returning to the description of FIG. 1, in the sound pickup space, each of the linear microphone arrays MCA11 is used as either of the main sound source linear microphone array or the auxiliary sound source linear microphone array while the sound is picked up in the sound field.

In this example, the linear microphone array MCA11-1 arranged ahead of the main sound source MA11 is set as the main sound source linear microphone array. Meanwhile, the linear microphone array MCA11-2 to the linear microphone array MCA11-4 arranged behind the linear microphone array MCA11-1 when viewed from the main sound source MA11 are set as the auxiliary sound source linear microphone arrays.

As a case of picking up the sounds from the main sound source MA11 and the auxiliary sound source SA11 as described above, for example, a use case where a musical instrument played in performance serves as the main sound source MA11 and an applauding audience of the performance serves as the auxiliary sound source SA11 is considered. In such a use case, a system is employed such as one in which the performance is recorded mainly with the main sound source linear microphone array and the applause is recorded with the auxiliary sound source linear microphone array.

Note that, to make the following description simpler, the description will continue by assuming that the linear microphone array MCA11-1 is used as the main sound source linear microphone array, the linear microphone array MCA11-4 is used as the auxiliary sound source linear microphone array, and the remainder, namely, the linear microphone array MCA11-2 and the linear microphone array MCA11-3 are not used.

The sound field for which the sound is picked up in the sound pickup space as described above is reproduced in the reproduction space illustrated on the right side in FIG. 1 using a linear speaker array SPA11-1 to a linear speaker array SPA11-4 corresponding to the linear microphone array MCA11-1 to the linear microphone array MCA11-4, respectively.

In the reproduction space, the linear speaker array SPA11-1 to the linear speaker array SPA11-4 are arranged in a square shape so as to enclose the listening area HA11. Note that, hereinafter, the linear speaker array SPA11-1 to the linear speaker array SPA11-4 are simply referred to as linear speaker arrays SPA11 when it is not necessary to particularly distinguish these linear speaker arrays from one another.

Here, the sound field in the sound pickup space cannot be accurately reproduced by merely playing back the sound picked up with the linear microphone array MCA11-1 using the linear speaker array SPA11-1 corresponding to the linear microphone array MCA11-1 and playing back the sound picked up with the linear microphone array MCA11-4 using the linear speaker array SPA11-4 corresponding to the linear microphone array MCA11-4.

For example, as indicated by arrows on the left side in FIG. 1, the sound of the performance which is a signal (sound) arriving from the main sound source MA11 and the sound of the applause which is a signal arriving from the auxiliary sound source SA11 by passing through the region AR11 are mixed when picked up by the linear microphone array MCA11-1.

For this reason, when the sound picked up with the linear microphone array MCA11-1 is played back as it is using the linear speaker array SPA11-1, a mixed signal in which the sound from the main sound source MA11 and the sound from the auxiliary sound source SA11 are mixed spreads toward a direction of the listening area HA11.

As a consequence, a listener hearing the sound in the listening area HA11 gets an impression as if the auxiliary sound source SA11 is located at a position on an exact opposite side of an original position where the auxiliary sound source SA11 should be located. Specifically, in an original situation, the sound from the auxiliary sound source SA11 arrives to the listening area HA11 from a lower side in FIG. 1. However, the listener hears as if the sound from the auxiliary sound source SA11 arrives to the listening area HA11 from an upper side in FIG. 1.

Likewise, as indicated by arrows on the left side in FIG. 1, the sound of the applause which is a signal arriving from the auxiliary sound source SA11 and the sound of the performance which is a signal arriving from the main sound source MA11 by passing through the region AR11 are mixed as well when picked up by the linear microphone array MCA11-4.

For this reason, when the sound picked up with the linear microphone array MCA11-4 is played back as it is using the linear speaker array SPA11-4, a mixed signal in which the sound from the auxiliary sound source SA11 and the sound from the main sound source MA11 are mixed spreads toward a direction of the listening area HA11.

As a consequence, the listener hearing the sound in the listening area HA11 gets an impression as if the main sound source MA11 is located at a position on an exact opposite side of an original position where the main sound source MA11 should be located. Specifically, in an original situation, the sound from the main sound source MA11 arrives to the listening area HA11 from the upper side in FIG. 1. However, the listener hears as if the sound from the main sound source MA11 arrives to the listening area HA11 from the lower side in FIG. 1.

As described above, because the sound from the main sound source MA11 (the sound of the musical instrument played in the performance) and the sound from the auxiliary sound source SA11 (applause) arriving from different directions from each other are mixed with each other, the sound field cannot be accurately reproduced by merely playing back the sounds picked up with the linear microphone arrays MCA11.

For a solution to this, in order to reduce the influence caused by mixing of a sound arriving from a direction different from that of the sound source for which the sound is mainly to be picked up, the present technique uses the sound from the main sound source MA11 picked up with the microphone MMC11 to carry out main sound source emphasis processing and main sound source reduction processing.

Specifically, the sound picked up with the microphone MMC11 is a sound in which the sound from the auxiliary sound source SA11 is recorded at a volume sufficiently smaller than that of the sound from the main sound source MA11 and thus, the feature amount representing a feature of the sound from the main sound source MA11 (hereinafter, also referred to as main sound source feature amount) can be extracted with ease from the sound picked up with the microphone MMC11.

The present technique uses the main sound source feature amount to carry out the main sound source emphasis processing on the sound pickup signal obtained by picking up the sound with the linear microphone array MCA11-1. In the main sound source emphasis processing, sound components of the main sound source MA11, specifically, components of the sound of the performance are exclusively emphasized. Thereafter, the sound is played back in the linear speaker array SPA11-1 on the basis of the sound pickup signal subjected to the main sound source emphasis processing.

Meanwhile, the main sound source feature amount is used to carry out the main sound source reduction processing on the sound pickup signal obtained by picking up the sound with the linear microphone array MCA11-4. In the main sound source reduction processing, sound components of the auxiliary sound source SA11, specifically, components of the sound of the applause are emphasized to thereby relatively reduce the sound components of the main sound source MA11 exclusively. Thereafter, the sound is played back in the linear speaker array SPA11-4 on the basis of the sound pickup signal subjected to the main sound source reduction processing.

As a result of the processing described above, the listener in the listening area HA11 is able to hear the sound of the performance from the main sound source MA11 as arriving from the upper side in FIG. 1 and the sound of the applause from the auxiliary sound source SA11 as arriving from the lower side in FIG. 1. Consequently, it is made possible to further accurately reproducing, in the reproduction space, a certain sound field in the sound pickup space.

In other words, because the present technique does not need any limitation provided for a size and a shape of the region AR11 corresponding to the listening area HA11, the arrangement of the linear microphone array MCA11, and the like, any sound field in the sound pickup space can be further accurately reproduced.

Note that, in FIG. 1, an example where the respective linear microphone arrays MCA11 constituting a square type microphone array are set as the main sound source linear microphone array or the auxiliary sound source linear microphone array has been described. However, some of microphone arrays constituting a sphere-shaped microphone array or a ring-shaped microphone array may be set as a microphone array for mainly picking up the sound from the main sound source, which corresponds to the main sound source linear microphone array, and a microphone array for mainly picking up the sound from the auxiliary sound source, which corresponds to the auxiliary sound source linear microphone array.

<Exemplary Configuration of Main Sound Source-Emphasizing Sound Field Reproduction Unit>

Next, a specific embodiment to which the present technique is applied will be described using, as an example, a case where the present technique is applied to a main sound source-emphasizing sound field reproduction unit.

Figure 3:
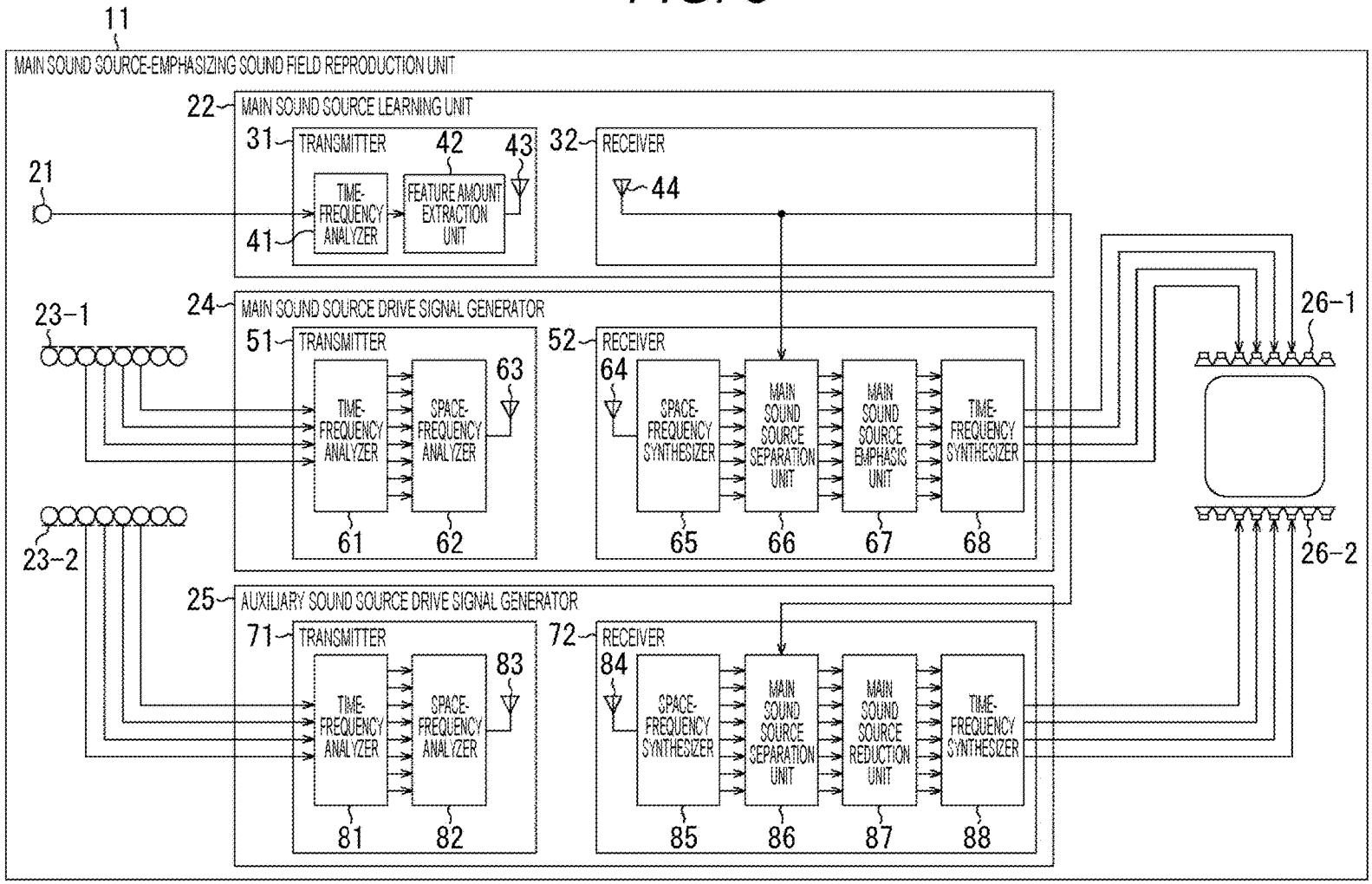
FIG. 3 is a diagram illustrating an exemplary configuration of a main sound source-emphasizing sound field reproduction unit.

FIG. 3 is a diagram illustrating an exemplary configuration of a main sound source-emphasizing sound field reproduction unit to which the present technique is applied according to an embodiment.

The main sound source-emphasizing sound field reproduction unit 11 is constituted by a microphone 21, a main sound source learning unit 22, a microphone array 23-1, a microphone array 23-2, a main sound source drive signal generator 24, an auxiliary sound source drive signal generator 25, a speaker array 26-1, and a speaker array 26-2.

For example, the microphone 21 is constituted by a single microphone or a plurality of microphones, alternatively, a microphone array and arranged in the vicinity of the main sound source in the sound pickup space. This microphone 21 corresponds to the microphone MMC11 illustrated in FIG. 1.

The microphone 21 picks up the sound emitting from the main sound source and supplies the sound pickup signal obtained as a result thereof to the main sound source learning unit 22.

On the basis of the sound pickup signal supplied from the microphone 21, the main sound source learning unit 22 extracts the main sound source feature amount from the sound pickup signal to supply to the main sound source drive signal generator 24 and the auxiliary sound source drive signal generator 25. Consequently, the feature amount of the main sound source is learned in the main sound source learning unit 22.

The main sound source learning unit 22 is constituted by a transmitter 31 arranged in the sound pickup space and a receiver 32 arranged in the reproduction space.

The transmitter 31 has a time-frequency analyzer 41, a feature amount extraction unit 42, and a communication unit 43. The time-frequency analyzer 41 carries out time-frequency conversion on the sound pickup signal supplied from the microphone 21 and supplies a time-frequency spectrum obtained as a result thereof to the feature amount extraction unit 42. The feature amount extraction unit 42 extracts the main sound source feature amount from the time-frequency spectrum supplied from the time-frequency analyzer 41 to supply to the communication unit 43. The communication unit 43 transmits the main sound source feature amount supplied from the feature amount extraction unit 42 to the receiver 32 in a wired or wireless manner.

The receiver 32 includes a communication unit 44. The communication unit 44 receives the main sound source feature amount transmitted from the communication unit 43 to supply to the main sound source drive signal generator 24 and the auxiliary sound source drive signal generator 25.

The microphone array 23-1 includes a linear microphone array and functions as the main sound source linear microphone array. That is, the microphone array 23-1 corresponds to the linear microphone array MCA11-1 illustrated in FIG. 1. The microphone array 23-1 picks up the sound in the sound field in the sound pickup space and supplies the sound pickup signal obtained as a result thereof to the main sound source drive signal generator 24.

The microphone array 23-2 includes a linear microphone array and functions as the auxiliary sound source linear microphone array. That is, the microphone array 23-2 corresponds to the linear microphone array MCA11-4 illustrated in FIG. 1. The microphone array 23-2 picks up the sound in the sound field in the sound pickup space and supplies the sound pickup signal obtained as a result thereof to the auxiliary sound source drive signal generator 25.

Note that, it is assumed hereinafter that the microphone array 23-1 and the microphone array 23-2 are also referred to simply as microphone arrays 23 when it is not necessary to particularly distinguish these microphone arrays from each other.

On the basis of the main sound source feature amount supplied from the main sound source learning unit 22, the main sound source drive signal generator 24 extracts the main sound source component from the sound pickup signal supplied from the microphone array 23-1 and also generates, as a speaker drive signal for the main sound source, a signal in which the extracted main sound source components are emphasized, to supply to the speaker array 26-1. The processing carried out by the main sound source drive signal generator 24 corresponds to the main sound source emphasis processing which has been described with reference to FIG. 1.

The main sound source drive signal generator 24 is constituted by a transmitter 51 arranged in the sound pickup space and a receiver 52 arranged in the reproduction space.

The transmitter 51 has a time-frequency analyzer 61, a space-frequency analyzer 62, and a communication unit 63.

The time-frequency analyzer 61 carries out the time-frequency conversion on the sound pickup signal supplied from the microphone array 23-1 and supplies a time-frequency spectrum obtained as a result thereof to the space-frequency analyzer 62. The space-frequency analyzer 62 carries out space-frequency conversion on the time-frequency spectrum supplied from the time-frequency analyzer 61 and supplies a space-frequency spectrum obtained as a result thereof to the communication unit 63. The communication unit 63 transmits the space-frequency spectrum supplied from the space-frequency analyzer 62 to the receiver 52 in a wired or wireless manner.

The receiver 52 has a communication unit 64, a space-frequency synthesizer 65, a main sound source separation unit 66, a main sound source emphasis unit 67, and a time-frequency synthesizer 68.

The communication unit 64 receives the space-frequency spectrum transmitted from the communication unit 63 to supply to the space-frequency synthesizer 65. After finding the drive signal for the speaker array 26-1 in a spatial region from the space-frequency spectrum supplied from the communication unit 64, the space-frequency synthesizer 65 carries out inverse space-frequency conversion and supplies the time-frequency spectrum obtained as a result thereof to the main sound source separation unit 66.

On the basis of the main sound source feature amount supplied from the communication unit 44, the main sound source separation unit 66 separates the time-frequency spectrum supplied from the space-frequency synthesizer 65 into a main sound source time-frequency spectrum serving as the main sound source component and an auxiliary sound source time-frequency spectrum serving as the auxiliary sound source component, to supply to the main sound source emphasis unit 67.

On the basis of the main sound source time-frequency spectrum and the auxiliary sound source time-frequency spectrum supplied from the main sound source separation unit 66, the main sound source emphasis unit 67 generates a main sound source-emphasized time-frequency spectrum in which the main sound source components are emphasized, to supply to the time-frequency synthesizer 68. The time-frequency synthesizer 68 carries out time-frequency synthesis of the main sound source-emphasized time-frequency spectrum supplied from the main sound source emphasis unit 67 and supplies the speaker drive signal obtained as a result thereof to the speaker array 26-1.

On the basis of the main sound source feature amount supplied from the main sound source learning unit 22, the auxiliary sound source drive signal generator 25 extracts the main sound source component from the sound pickup signal supplied from the microphone array 23-2 and also generates, as the speaker drive signal for the auxiliary sound source, a signal in which the extracted main sound source components are reduced, to supply to the speaker array 26-2. The processing carried out by the auxiliary sound source drive signal generator 25 corresponds to the main sound source reduction processing which has been described with reference to FIG. 1.

The auxiliary sound source drive signal generator 25 is constituted by a transmitter 71 arranged in the sound pickup space and a receiver 72 arranged in the reproduction space.

The transmitter 71 has a time-frequency analyzer 81, a space-frequency analyzer 82, and a communication unit 83.

The time-frequency analyzer 81 carries out the time-frequency conversion on the sound pickup signal supplied from the microphone array 23-2 and supplies the time-frequency spectrum obtained as a result thereof to the space-frequency analyzer 82. The space-frequency analyzer 82 carries out the space-frequency conversion on the time-frequency spectrum supplied from the time-frequency analyzer 81 and supplies the space-frequency spectrum obtained as a result thereof to the communication unit 83. The communication unit 83 transmits the space-frequency spectrum supplied from the space-frequency analyzer 82 to the receiver 72 in a wired or wireless manner.

The receiver 72 has a communication unit 84, a space-frequency synthesizer 85, a main sound source separation unit 86, a main sound source reduction unit 87, and a time-frequency synthesizer 88.

The communication unit 84 receives the space-frequency spectrum transmitted from the communication unit 83 to supply to the space-frequency synthesizer 85. After finding the drive signal for the speaker array 26-2 in the spatial region from the space-frequency spectrum supplied from the communication unit 84, the space-frequency synthesizer 85 carries out the inverse space-frequency conversion and supplies the time-frequency spectrum obtained as a result thereof to the main sound source separation unit 86.

On the basis of the main sound source feature amount supplied from the communication unit 44, the main sound source separation unit 86 separates the time-frequency spectrum supplied from the space-frequency synthesizer 85 into the main sound source time-frequency spectrum and the auxiliary sound source time-frequency spectrum, to supply to the main sound source reduction unit 87.

On the basis of the main sound source time-frequency spectrum and the auxiliary sound source time-frequency spectrum supplied from the main sound source separation unit 86, the main sound source reduction unit 87 generates a main sound source-reduced time-frequency spectrum in which the main sound source components are reduced, that is, the auxiliary sound source components are emphasized, to supply to the time-frequency synthesizer 88. The time-frequency synthesizer 88 carries out the time-frequency synthesis of the main sound source-reduced time-frequency spectrum supplied from the main sound source reduction unit 87 and supplies the speaker drive signal obtained as a result thereof to the speaker array 26-2.

The speaker array 26-1 includes, for example, a linear speaker array and corresponds to the linear speaker array SPA11-1 in FIG. 1. The speaker array 26-1 plays back the sound on the basis of the speaker drive signal supplied from the time-frequency synthesizer 68. As a result, the sound from the main sound source in the sound pickup space is reproduced.

The speaker array 26-2 includes, for example, a linear speaker array and corresponds to the linear speaker array SPA11-4 in FIG. 1. The speaker array 26-2 plays back the sound on the basis of the speaker drive signal supplied from the time-frequency synthesizer 88. As a result, the sound from the auxiliary sound source in the sound pickup space is reproduced.

Note that, it is assumed hereinafter that the speaker array 26-1 and the speaker array 26-2 are also referred to simply as speaker arrays 26 when it is not necessary to particularly distinguish these speaker arrays from each other.

Here, the respective members constituting the main sound source-emphasizing sound field reproduction unit 11 will be described in more detail.

(Time-Frequency Analyzer)

First, the time-frequency analyzer 41, the time-frequency analyzer 61, and the time-frequency analyzer 81 will be described. The description will continue by using the time-frequency analyzer 61 as an example here.

The time-frequency analyzer 61 analyzes time-frequency information in the sound pickup signal $s(n_{mic}, t)$ obtained at each of microphones (microphone sensors) constituting the microphone array 23-1.

Note that $n_{mic}$ in the sound pickup signal $s(n_{mic}, t)$ represents a microphone index indicating the microphone constituting the microphone array 23-1, where the microphone index is expressed as $n_{mic}=0, \ldots, N_{mic}-1$. Additionally, $N_{mic}$ represents the number of the microphones constituting the microphone array 23-1 and t represents a time.

The time-frequency analyzer 61 obtains an input frame signal $s_{fr}(n_{mic}, n_{fr}, l)$ subjected to time frame division into a fixed size from the sound pickup signal $s(n_{mic}, t)$. Subsequently, the time-frequency analyzer 61 multiplies the input frame signal $s_{fr}(n_{mic}, n_{fr}, l)$ by a window function $w_T(n_{fr})$ indicated by following formula (1) to obtain a window function-applied signal $s_w(n_{mic}, n_{fr}, l)$. Specifically, following formula (2) is calculated and the window function-applied signal $s_w(n_{mic}, n_{fr}, l)$ is worked out.

[Mathematical Formula 1]

$$w_T(n_{fr}) = \left(0.5 - 0.5\cos\left(2\pi\frac{n_{fr}}{N_{fr}}\right)\right)^{0.5} \tag{1}$$

[Mathematical Formula 2]

$$s_w(n_{mic}, n_{fr}, l) = w_T(n_{fr})s_{fr}(n_{mic}, n_{fr}, l) \tag{2}$$

Here, $n_{fr}$ in formula (1) and formula (2) represents a time index, where the time index is expressed as $n_{fr}=0, \ldots, N_{fr}-1$. Meanwhile, l represents a time frame index, where the time frame index is expressed as $l=0, \ldots, L-1$. Additionally, $N_{fr}$ represents a frame size (the number of samples in a time frame), whereas L represents a total number of frames.

In addition, the frame size $N_{fr}$ represents the number of samples $N_{fr}$ equivalent to a time $T_{fr}$ [s] of one frame at a time sampling frequency $f_s^T$ [Hz] ($=R(f_s^T \times T_{fr})$, where R( ) is any rounding function). In this embodiment, for example, the time of one frame is set as $T_{fr}=1.0$ [s], where half round up is used as the rounding function R( ). However, another rounding function may be employed. Similarly, although a shift amount of the frame is set as 50% of the frame size $N_{fr}$, another shift amount may be employed.

Furthermore, a square root of a Hanning window is used here as the window function. However, another window such as a Hamming window or a Blackman-Harris window may be employed to be used therefor.

Once the window function-applied signal $s_w(n_{mic}, n_{fr}, l)$ is obtained as described above, the time-frequency analyzer 61 calculates formula (3) and formula (4) below to carry out the time-frequency conversion on the window function-applied signal $s_w(n_{mic}, n_{fr}, l)$, thereby working out the time-frequency spectrum $S(n_{mic}, n_T, l)$.

[Mathematical Formula 3]

$$s'_w(n_{mic}, n_T, l) = \begin{cases} s_w(n_{mic}, m_T, l) & m_T = 0, \ldots, N_{fr}-1 \\ 0 & m_T = N_{fr}, \ldots, M_T-1 \end{cases} \tag{3}$$

[Mathematical Formula 4]

$$S(n_{mic}, n_T, l) = \sum_{m_T=0}^{M_T-1} S'_w(n_{mic}, m_T, l)\exp\left(-i2\pi\frac{m_T n_T}{M_T}\right) \tag{4}$$

Specifically, a zero-padded signal $s_w'(n_{mic}, m_T, l)$ is found through the calculation of formula (3) and then, formula(4)

is calculated on the basis of the obtained zero-padded signal $s_w'$ ($n_{mic}$, $m_T$, l), whereby the time-frequency spectrum S ($n_{mic}$, $n_T$, l) is worked out.

Note that, $M_T$ in formula (3) and formula (4) represents the number of points used in the time-frequency conversion. Meanwhile, $n_T$ represents a time-frequency spectrum index. Here, $N_T=M_T/2+1$ and $n_T=0, \ldots, N_T-1$ are assumed. In addition, i in formula (4) represents a pure imaginary number.

Additionally, in this embodiment, the time-frequency conversion is carried out according to short time Fourier transform (STFT). However, other time-frequency conversion such as discrete cosine transform (DCT) or modified discrete cosine transform (MDCT) may be used.

Additionally, the number of points $M_T$ for the STFT is set to a value of the second power equal to or larger than $N_{fr}$ and closest to $N_{fr}$. However, the number of points $M_T$ may be set to a value other than that.

The time-frequency analyzer 61 supplies the time-frequency spectrum S($n_{mic}$, $n_T$, l) obtained through the processing described above to the space-frequency analyzer 62.

By carrying out processing similar to that of the time-frequency analyzer 61, the time-frequency analyzer 41 also works out the time-frequency spectrum from the sound pickup signal supplied from the microphone 21 to supply to the feature amount extraction unit 42. In addition, the time-frequency analyzer 81 also works out the time-frequency spectrum from the sound pickup signal supplied from the microphone array 23-2 to supply to the space-frequency analyzer 82.

(Feature Amount Extraction Unit)

The feature amount extraction unit 42 extracts the main sound source feature amount from the time-frequency spectrum S ($n_{mic}$, $n_T$, l) supplied from the time-frequency analyzer 41.

As an extraction approach for the main sound source feature amount, an approach for learning the frequency basis of the main sound source using nonnegative tensor factorization (NTF) will be described here as an example. However, the main sound source feature amount may be configured to be extracted using another approach. Note that, the NTF is described in detail in "Derry FitzGerald et al., "Non-Negative Tensor Factorisation for Sound Source Separation", ISSC 2005, Dublin, Sep. 1-2.", for example.

The feature amount extraction unit 42 first calculates following formula (5) as pre-processing to convert the time-frequency spectrum S ($n_{mic}$, $n_T$, l) to a nonnegative spectrum V (j, k, l).

[Mathematical Formula 5]

$$V(j,k,l)=(S(j,k,l)\times \mathrm{conj}(S(j,k,l))^{\rho} \quad (5)$$

Here, the microphone index $n_{mic}$ in the time-frequency spectrum S ($n_{mic}$, $n_T$, l) is replaced with a channel index j, whereas the time-frequency spectrum index $n_T$ therein is replaced with a frequency index k. Accordingly, the microphone index $n_{mic}$ is noted as j and the time-frequency spectrum index $n_T$ is noted as k. In addition, $N_{mic}=J$ and $N_T=K$ are assumed. In this case, one microphone identified by the microphone index $n_{mic}$ is to be treated as one channel.

Additionally, in formula (5), conj (S (j, k, l)) represents a complex conjugate of the time-frequency spectrum S (j, k, l) and ρ represents a control value for the conversion to nonnegative value. The control value ρ for the conversion to nonnegative value may be set to any type of value but, for example, the control value for the conversion to nonnegative value here is set as ρ=1.

The nonnegative spectra V (j, k, l) obtained through the calculation of formula (5) are coupled in a time direction to be represented as a nonnegative spectrogram V and used as input during the NTF.

For example, when the nonnegative spectrogram V is interpreted as a three-dimensional tensor of J×K×L, the nonnegative spectrogram V can be separated into P number of three-dimensional tensors $V_p'$ (hereinafter, also referred to as basis spectrogram).

Here, p represents a basis index indicating the basis spectrogram and is expressed as p=0, . . . , P−1, where P represents a basis number. Hereinafter, it is assumed that a basis represented by the basis index p is also referred to as basis p.

Additionally, each of P number of the three-dimensional tensors Vp' can be expressed as a direct product of three vectors and thus is factorized into three vectors. As a result of collecting P number of the vectors for each of the three types of the vectors, three matrices, namely, a channel matrix Q, a frequency matrix W, and a time matrix H are newly obtained; therefore, it is consequently considered that the nonnegative spectrogram V can be factorized into three matrices. Note that, the size of the channel matrix Q is expressed as J×P, the size of the frequency matrix W is expressed as K×P, and the size of the time matrix H is expressed as L×P.

Note that, hereinafter, lowercase letters will be used in the notation when respective elements of the three-dimensional tensors or the matrices are represented. For example, the respective elements of the nonnegative spectrogram V are expressed as $v_{jkl}$, whereas the respective elements of the channel matrix Q are expressed as $q_{jkl}$. In addition, it is assumed that $v_{jkl}$ is also noted as $[V]_{jkl}$, for example. Other matrices are assumed to be noted similarly to this and, for example, $q_{jkl}$ is also noted as $[Q]_{jkl}$.

The feature amount extraction unit 42 minimizes an error tensor E by using the nonnegative tensor factorization (NTF) while the tensor factorization is carried out. Each of the channel matrix Q, the frequency matrix W, and the time matrix H obtained through the tensor factorization has a characteristic property.

Here, the channel matrix Q, the frequency matrix W, and the time matrix H will be described.

Figure 4:
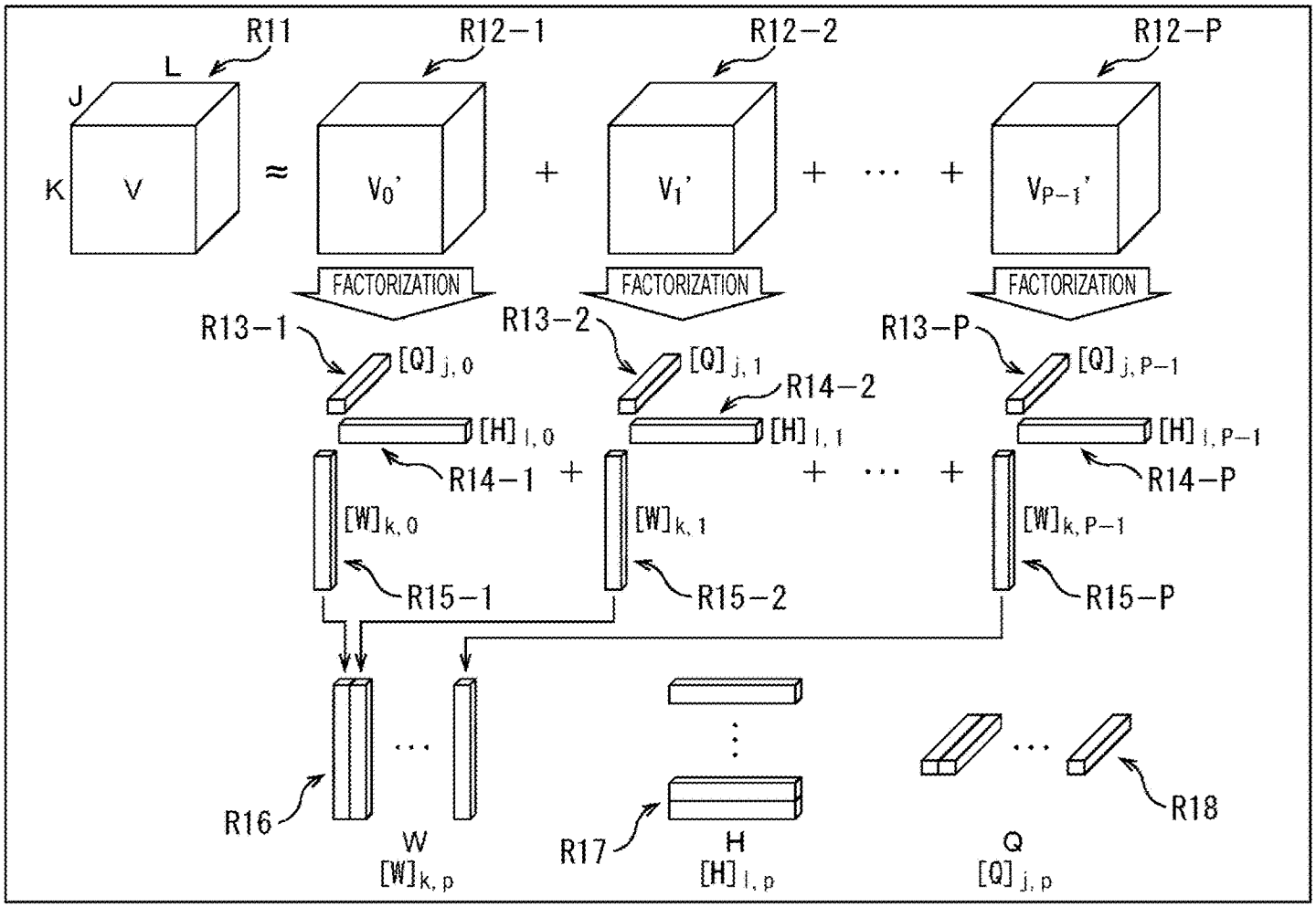
FIG. 4 is a diagram for describing tensor factorization.

For example, as illustrated in FIG. 4, it is assumed that, as a result of factorizing a three-dimensional tensor obtained by excluding the error tensor E from the nonnegative spectrogram V indicated by an arrow R11 into P number of three-dimensional tensors, where P represents the basis number, the basis spectrogram $V_0'$ to the basis spectrogram $V_{P-1}'$ indicated by an arrow R12-1 to an arrow R12-P, respectively, are obtained.

Each of these basis spectrograms $V_p'$ (where p=0, . . . , P−1), namely, the aforementioned three-dimensional tensors $V_p'$ can be expressed as the direct product of three vectors.

For example, the basis spectrogram $V_0'$ can be expressed as the direct product of three vectors, namely, a vector $[Q]_{j,0}$ indicated by an arrow R13-1, a vector $[H]_{1,0}$ indicated by an arrow R14-1, and a vector $[W]_{k,0}$ indicated by an arrow R15-1.

The vector $[Q]_{j,0}$ is a column vector constituted by J number of elements, where J represents a total number of channels, and each of J number of elements in the vector $[Q]_{j,0}$ is a component corresponding to each of the channels (microphones) indicated by the channel index j.

Meanwhile, the vector $[H]_{l,0}$ is a row vector constituted by L number of elements, where L represents a total number of time frames, and each of L number of elements in the vector $[H]_{l,0}$ is a component corresponding to each of the time frames indicated by the time frame index l. Additionally, the vector $[W]_{k,0}$ is a column vector constituted by K number of elements, where K represents a frequency (time frequency) number, and each of K number of elements in the vector $[W]_{k,0}$ is a component corresponding to a frequency indicated by the frequency index k.

The vector $[Q]_{j,0}$, the vector $[H]_{l,0}$, and the vector $[W]_{k,0}$ described above represent a property of a channel direction, a property of the time direction, and a property of a frequency direction of the basis spectrogram $V_0'$, respectively.

Likewise, the basis spectrogram $V_1'$ can be expressed as the direct product of three vectors, namely, a vector $[Q]_{j,1}$ indicated by an arrow R13-2, a vector $[H]_{l,1}$ indicated by an arrow R14-2, and a vector $[W]_{k,1}$ indicated by an arrow R15-2. In addition, the basis spectrogram $V_{P-1}'$ can be expressed as the direct product of three vectors, namely, a vector $[Q]_{j,P-1}$ indicated by an arrow R13-P, a vector $[H]_{l,P-1}$ indicated by an arrow R14-P, and a vector $[W]_{k,P-1}$ indicated by an arrow R15-P.

Thereafter, the respective three types of vectors corresponding to the respective three dimensions of each of P number of the basis spectrograms $V_p'$ are collected for each of the dimensions to form matrices which are obtained as the channel matrix Q, the frequency matrix W, and the time matrix H.

Specifically, as indicated by an arrow R16 on the lower side in FIG. 4, a matrix constituted by vectors representing the properties of the frequency directions of the respective basis spectrograms $V_p'$, namely, the vector $[W]_{k,0}$ to the vector $[W]_{k,P-1}$ is set as the frequency matrix W.

Likewise, as indicated by an arrow R17, a matrix constituted by vectors representing the properties of the time directions of the respective basis spectrograms $V_p'$, namely, the vector $[H]_{1,0}$ to the vector $[H]_{1,P-1}$ is set as the time matrix H. In addition, as indicated by an arrow R18, a matrix constituted by vectors representing the properties of the channel directions of the respective basis spectrograms $V_p'$, namely, the vector $[Q]_{j,0}$ to the vector $[Q]_{j,P-1}$ is set as the channel matrix Q.

Because of the property of the nonnegative tensor factorization (NTF), each of the basis spectrograms $V_p'$ separated into P number of shares is caused to learn so as to individually represent a specific property within the sound source. In the NTF, all elements are restricted to nonnegative values, and thus, additive combinations of the basis spectrograms $V_p'$ are only allowed. As a result, the number of patterns of the combinations is reduced, thereby enabling easier separation according to the property specific to the sound source. Consequently, by selecting the basis index p in an arbitrary range, respective point sound sources are extracted, whereby acoustic processing can be achieved.

Here, the properties of the respective matrices, specifically, the channel matrix Q, the frequency matrix W, and the time matrix H will be further described.

The channel matrix Q represents the property of the channel direction of the nonnegative spectrogram V. It is therefore considered that the channel matrix Q represents the degree of contribution to each of J number of the channels j in total in each of P number of the basis spectrograms $V_p'$.

The frequency matrix W represents the property of the frequency direction of the nonnegative spectrogram V. More specifically, the frequency matrix W represents the degree of contribution to each of K number of frequency bins in P number of the basis spectrograms $V_p'$ in total, that is, a frequency characteristic of each of the basis spectrograms $V_p'$.

In addition, the time matrix H represents the property of the time direction of the nonnegative spectrogram V. More specifically, the time matrix H represents the degree of contribution to each of L number of time frames in total in each of P number of the basis spectrograms $V_p'$, that is, a time characteristic of each of the basis spectrograms $V_p'$.

Returning to the description of working out the main sound source feature amount by the feature amount extraction unit 42, the NTF (nonnegative tensor factorization) minimizes a cost function C with respect to the channel matrix Q, the frequency matrix W, and the time matrix H through the calculation of following formula (6), whereby the optimized channel matrix Q, the optimized frequency matrix W, and the optimized time matrix H are found.

[Mathematical Formula 6]

$$\min_{Q,W,H} C(V \mid V') \stackrel{def}{=} \sum_{jkl} d_\beta(v_{jkl} \mid v'_{jkl}) \text{ subject to } Q, W, H \geq 0 \tag{6}$$

Note that, in formula (6), $v_{jkl}$ represents the elements of the nonnegative spectrogram V, whereas $v_{jkl}'$ serves as a predicted value of the element $v_{jkl}$. This element $v_{jkl}'$ is obtained using following formula (7). Note that, in formula (7), $q_{jp}$ represents elements constituting the channel matrix Q and identified by the channel index j and the basis index p, namely, a matrix element $[Q]_{j,p}$. Likewise, $w_{kp}$ represents a matrix element $[W]_{k,p}$ and $h_{lp}$ represents a matrix element $[H]_{l,p}$.

[Mathematical Formula 7]

$$v'_{vkl} = \sum_{p=0}^{P-1} q_{jp} w_{kp} h_{lp} \tag{7}$$

A spectrogram constituted by the element $v_{jkl}'$ worked out using formula (7) serves as an approximate spectrogram V' which is a predicted value of the nonnegative spectrogram V. In other words, the approximate spectrogram V' is an approximate value of the nonnegative spectrogram V, which can be obtained from P number of the basis spectrograms $V_p'$, where P represents the basis number.

Additionally, in formula (6), β-divergence $d_\beta$ is used as an indicator for measuring a distance between the nonnegative spectrogram V and the approximate spectrogram V'. For example, this β-divergence is expressed by following formula (8), where x and y represent arbitrary variables.

[Mathematical Formula 8]

$$d_\beta(x \mid y) \stackrel{def}{=} \begin{cases} \frac{1}{\beta(\beta-1)}(x^\beta + (\beta-1)y^\beta - \beta x y^{\beta-1}) & \beta \notin \mathbb{R}\{0, 1\} \\ x\log\frac{x}{y} - x + y & \beta = 1 \\ \frac{x}{y} - \log\frac{x}{y} - 1 & \beta = 0 \end{cases} \tag{8}$$

Specifically, when β is not 1 or 0, the β-divergence is worked out using a formula illustrated on the uppermost side in formula (8). Meanwhile, in the case of β=1, the β-divergence is worked out using a formula illustrated at the middle in formula (8).

In addition, in the case of β=0 (Itakura-Saito distance), the β-divergence is worked out using a formula illustrated on the lowermost side in formula (8). Specifically, in the case of β=0, the arithmetic illustrated in following formula (9) is to be carried out.

[Mathematical Formula 9]

$$d_{\beta=0}(x \mid y) = \frac{x}{y} - \log\frac{x}{y} - 1 \tag{9}$$

Furthermore, partial differentiation with respect to y in the β-divergence $d_{\beta=0}(x|y)$ in the case of β=0 is as illustrated in following formula (10).

[Mathematical Formula 10]

$$d'_{\beta=0}(x \mid y) = \frac{1}{y} - \frac{x}{y^2} \tag{10}$$

Accordingly, in the example of formula (6), the β-divergence $D_0(V|V')$ is as illustrated in following formula (11). Meanwhile, partial differentiation with respect to the channel matrix Q, the frequency matrix W, and the time matrix H in the β-divergence $D_0(V|V')$ is as illustrated individually in formula (12) to formula (14) below. Note that all of subtraction, division, and logarithmic arithmetic in formula (11) to formula (14) are calculated for each element.

[Mathematical Formula 11]

$$D_0(V \mid V') = \sum_{jkl} d_{\beta=0}(v_{jkl} \mid v'_{jkl}) = \sum_{jkl}\left(\frac{v_{jkl}}{v'_{jkl}} - \log\frac{v_{jkl}}{v'_{jkl}} - 1\right) \tag{11}$$

[Mathematical Formula 12]

$$\nabla_{q_{jp}} D_0(V \mid V') = \sum_{kl} w_{kp} h_{lp} d'_{\beta=0}(v_{jkl} \mid v'_{jkl}) \tag{12}$$

[Mathematical Formula 13]

$$\nabla_{w_{kp}} D_0(V \mid V') = \sum_{jl} q_{jp} h_{lp} d'_{\beta=0}(v_{jkl} \mid v'_{jkl}) \tag{13}$$

[Mathematical Formula 14]

$$\nabla_{h_{lp}} D_0(V \mid V') = \sum_{jk} q_{jp} w_{kp} d'_{\beta=0}(v_{jkl} \mid v'_{jkl}) \tag{14}$$

Subsequently, an update formula in the NTF is as illustrated in following formula (15) when expressed using a parameter θ simultaneously representing the channel matrix Q, the frequency matrix W, and the time matrix H. Note that, in formula (15), a sign "·" represents multiplication for each element and division is calculated for each element.

[Mathematical Formula 15]

$$\theta \leftarrow \theta \cdot \frac{[\nabla_\theta D_0(V \mid V')]_-}{[\nabla_\theta D_0(V \mid V')]_+} \tag{15}$$

where $$\nabla_\theta D_0(V \mid V') = [\nabla_\theta D_0(V \mid V')]_+ - [\nabla_\theta D_0(V \mid V')]_-$$

Note that, in formula (15), $[\sigma_\theta D_0\ (V|V')]_+$ and $[\sigma_\theta D_0\ (V|V')]_-$ represent a positive portion and a negative portion in a function $\sigma_\theta D_0\ (V|V')$, respectively.

Accordingly, the update formulas in the NTF for the respective matrices in the case of formula (6), that is, in a case where a constraint function is not considered are expressed as formulas illustrated in formula (16) to formula (18) below. Note that all of factorial and division in formula (16) to formula (18) are calculated for each element.

[Mathematical Formula 16]

$$Q \leftarrow Q \cdot \frac{\langle V/V'^2, W \circ H\rangle_{\{2,3\},\{1,2\}}}{\langle 1/V', W \circ H\rangle_{\{2,3\},\{1,2\}}} \tag{16}$$

[Mathematical Formula 17]

$$W \leftarrow W \cdot \frac{\langle V/V'^2, Q \circ H\rangle_{\{1,3\},\{1,2\}}}{\langle 1/V', Q \circ H\rangle_{\{1,3\},\{1,2\}}} \tag{17}$$

[Mathematical Formula 18]

$$H \leftarrow H \cdot \frac{\langle V/V'^2, Q \circ W\rangle_{\{1,2\},\{1,2\}}}{\langle 1/V', Q \circ W\rangle_{\{1,2\},\{1,2\}}} \tag{18}$$

Note that, signs "○" in formula (16) to formula (18) represent the direct products of the matrices. Specifically, when A is a matrix $i_A \times P$ and B is a matrix $i_B \times P$, "A ○ B" represents a three-dimensional tensor of $i_A \times i_B \times P$.

Additionally, $\langle A,B\rangle_{(C),(D)}$ is called a contraction product of tensor and expressed by following formula (19). As for formula (19), however, respective letters therein are assumed not to be related to the signs representing the matrices and the like described thus far.

[Mathematical Formula 19]

$$\langle A, B\rangle_{\{1,\ldots,M\},\{1,\ldots,M\}} = \sum_{i_1=1}^{I_1} \cdots \sum_{i_M=1}^{I_M} a_{i_1 \ldots i_M, j_1 \ldots j_N} b_{i_1 \ldots i_M, k_1 \ldots k_P} \tag{19}$$

The feature amount extraction unit 42 minimizes the cost function C in formula (6) while updating the channel matrix Q, the frequency matrix W, and the time matrix H using formula (16) to formula (18), thereby finding the optimized channel matrix Q, the optimized frequency matrix W, and the optimized time matrix H. Thereafter, the feature amount extraction unit 42 supplies the obtained frequency matrix W to the communication unit 43 as the main sound source feature amount representing the feature of the main sound source regarding the frequency. Note that, it is assumed hereinafter that the frequency matrix W serving as the main sound source feature amount is also referred to as main sound source frequency matrix $W_s$ in particular.

(Space-Frequency Analyzer)

Subsequently, the space-frequency analyzer 62 and the space-frequency analyzer 82 will be described. Here, the space-frequency analyzer 62 will be mainly described.

The space-frequency analyzer 62 calculates following formula (20) with respect to the time-frequency spectrum S ($n_{mic}$, $n_T$, l) supplied from the time-frequency analyzer 61 to carry out the space-frequency conversion, thereby working out the space-frequency spectrum $S_{SP}$ ($n_S$, $n_T$, l).

[Mathematical Formula 20]

$$S_{SP}(n_S, n_T, l) = \frac{1}{M_S}\sum_{m_S=0}^{M_S-1} S'(m_S, n_T, l)\exp\left(i2\pi\frac{m_S n_S}{M_S}\right) \tag{20}$$

Note that, $M_S$ in formula (20) represents the number of points used in the space-frequency conversion and is expressed as $m_S$=0, . . . , $M_S$−1. Meanwhile, S'($m_S$, $n_T$, l) represents a zero-padded signal obtained by padding zeros to the time-frequency spectrum S ($n_{mic}$, $n_T$, l) and i represents the pure imaginary number. In addition, $n_S$ represents a space-frequency spectrum index.

In this embodiment, the space-frequency conversion is carried out according to inverse discrete Fourier transform (IDFT) through the calculation of formula (20).

In addition, zero padding may be properly carried out in accordance with the number of points $M_S$ for the IDFT when necessary. In this embodiment, a space sampling frequency of the signal obtained at the microphone array 23-1 is assumed as $f_s^S$ [Hz]. This space sampling frequency $f_s^S$ [Hz] is determined based on intervals among the microphones constituting the microphone array 23-1.

In formula (20), for example, the number of points $M_S$ is determined on the basis of the space sampling frequency $f_s^S$ [Hz]. Additionally, as for a point $m_S$ for which $0 \le m_S \le N_{mic}-1$ holds, zero-padded signal S'($m_S$, $n_T$, l)=time-frequency spectrum S ($n_{mic}$, $n_T$, l) is set, whereas a point $m_S$ for which $N_{mic} \le m_S \le M_S-1$ holds, zero-padded signal S'($m_S$, $n_T$, l)=0 is set.

The space-frequency spectrum $S_{SP}$ ($n_S$, $n_T$, l) obtained through the processing described above indicates what waveform is formed in a space by a signal of a time frequency $n_T$ included in the time frame 1. The space-frequency analyzer 62 supplies the space-frequency spectrum $S_{SP}$ ($n_S$, $n_T$, l) to the communication unit 63.

In addition, by carrying out processing similar to that of the space-frequency analyzer 62, the space-frequency analyzer 82 also works out the space-frequency spectrum on the basis of the time-frequency spectrum supplied from the time-frequency analyzer 81 to supply to the communication unit 83.

(Space-Frequency Synthesizer)

Meanwhile, on the basis of the space-frequency spectrum $S_{SP}$ ($n_S$, $n_T$, l) supplied from the space-frequency analyzer 62 through the communication unit 64 and the communication unit 63, the space-frequency synthesizer 65 calculates following formula (21) to find a drive signal $D_{SP}$ ($m_S$, $n_T$, l) in the spatial region for reproducing the sound field (wave surface) using the speaker array 26-1. Specifically, the drive signal $D_{SP}$ ($m_S$, $n_T$, l) is worked out using a spectral division method (SDM).

[Mathematical Formula 21]

$$D_{SP}(m_S, n_T, l) = 4i\frac{\exp(-ik_{pw}y_{ref})}{H_0^{(2)}(k_{pw}y_{ref})}S_{SP}(n_S, n_T, l) \tag{21}$$

Here, $k_{pw}$ in formula (21) is obtained using following formula (22).

[Mathematical Formula 22]

$$k_{pw} = \sqrt{\left(\frac{\omega}{c}\right)^2 - k_x^2} \tag{22}$$

Note that, in formula (21) $y_{ref}$ represents a reference distance in the SDM and the reference distance $y_{ref}$ serves as a position where the wave surface is accurately reproduced. This reference distance $y_{ref}$ is a distance in a direction perpendicular to a direction in which the microphones in the microphone array 23-1 are placed in order. For example, the reference distance is here set as $y_{ref}$=1 [m]. However, another value may be employed.

In addition, $H_0^{(2)}$ represents a Hankel function and i represents the pure imaginary number in formula (21). Meanwhile, $m_S$ represents the space-frequency spectrum index. Furthermore, in formula (22), c represents speed of sound and ω represents a time angular frequency.

Note that, although an approach for working out the drive signal $D_{SP}$ ($m_S$, $n_T$, l) using the SDM has been described here as an example, the drive signal may be worked out using another approach. In addition, the SDM is described in detail particularly in "Jens Adrens, Sascha Spors, "Applying the Ambisonics Approach on Planar and Linear Arrays of Loudspeakers", in $2^{nd}$ International Symposium on Ambisonics and Spherical Acoustics".

Subsequently, the space-frequency synthesizer 65 calculates following formula (23) to carry out the inverse space-frequency conversion on the drive signal $D_{SP}$ ($m_S$, $n_T$, l) in the spatial region, thereby working out the time-frequency spectrum D ($n_{spk}$, $n_T$, l). In formula (23), discrete Fourier transform (DFT) is carried out as the inverse space-frequency conversion.

[Mathematical Formula 23]

$$D(n_{spk}, n_T, l) = \sum_{m_S=0}^{M_S-1} D_{SP}(m_S, n_T, l)\exp\left(-i2\pi\frac{m_S n_{spk}}{M_S}\right) \tag{23}$$

Note that, in formula (23), $n_{spk}$ represents a speaker index identifying the speaker constituting the speaker array 26-1. Meanwhile, $M_S$ represents the number of points for the DFT and i represents the pure imaginary number.

In formula (23), the drive signal $D_{SP}$ ($m_S$, $n_T$, l) serving as the space-frequency spectrum is converted to the time-frequency spectrum and at the same time, resampling of the drive signal is also carried out. Specifically, the space-frequency synthesizer 65 carries out the resampling (inverse space-frequency conversion) of the drive signal at a space sampling frequency in accordance with speaker intervals in the speaker array 26-1 to obtain the drive signal for the speaker array 26-1 that enables the reproduction of the sound field in the sound pickup space.

The space-frequency synthesizer 65 supplies the time-frequency spectrum D ($n_{spk}$, $n_T$, l) obtained as described above to the main sound source separation unit 66. In addition, by carrying out processing similar to that of the space-frequency synthesizer 65, the space-frequency synthesizer 85 also works out the time-frequency spectrum serving as the drive signal for the speaker array 26-2 to supply to the main sound source separation unit 86.

(Main Sound Source Separation Unit)

In the main sound source separation unit 66, the main sound source frequency matrix $W_S$ functioning as the main sound source feature amount supplied from the feature amount extraction unit 42 through the communication unit 44 and the communication unit 43 is used to extract the main sound source signal from the time-frequency spectrum D ($n_{spk}$, $n_T$, l) supplied from the space-frequency synthesizer 65. As in the case of the feature amount extraction unit 42, the NTF is used here to extract the main sound source signal (main sound source component).

Specifically, the main sound source separation unit 66 calculates following formula (24) to convert the time-frequency spectrum D($n_{spk}$, $n_T$, l) to the nonnegative spectrum $V_{SP}$(j, k, l).

[Mathematical Formula 24]

$$V_{SP}(j,k,l)=(D)(j,k,l)\times\mathrm{conj}(D(j,k,l)))^{\rho} \tag{24}$$

Here, the speaker index $n_{spk}$ in the time-frequency spectrum D ($n_{spk}$, $n_T$, l) is replaced with the channel index j, whereas the time-frequency spectrum index $n_T$ therein is replaced with the frequency index k.

Additionally, in formula (24), conj (D (j, k, l)) represents the complex conjugate of the time-frequency spectrum D (j, k, l) and ρ represents the control value for the conversion to nonnegative value. The control value ρ for the conversion to nonnegative value may be set to any type of value but, for example, the control value for the conversion to nonnegative value here is set as ρ=1.

The nonnegative spectra $V_{SP}$ (j, k, l) obtained through the calculation of formula (24) are coupled in the time direction to be represented as a nonnegative spectrogram $V_{SP}$ and used as input during the NTF.

In addition, with respect to the nonnegative spectrogram $V_{SP}$ obtained as described above, the main sound source separation unit 66 minimizes the cost function while updating the channel matrix Q, the frequency matrix W, and the time matrix H using the update formulas illustrated in formula (25) to formula (27) below, thereby finding the optimized channel matrix Q, the optimized frequency matrix W, and the optimized time matrix H.

[Mathematical Formula 25]

$$Q \leftarrow Q \cdot \frac{\langle V_{SP}/V_{SP}'^2,\ W\circ H\rangle_{\{2,3\},\{1,2\}}}{\langle 1/V_{SP}',\ W\circ H\rangle_{\{2,3\},\{1,2\}}} \tag{25}$$

[Mathematical Formula 26]

$$W \leftarrow W \cdot \frac{\langle V_{SP}/V_{SP}'^2,\ Q\circ H\rangle_{\{1,3\},\{1,2\}}}{\langle 1/V_{SP}',\ Q\circ H\rangle_{\{1,3\},\{1,2\}}} \tag{26}$$

[Mathematical Formula 27]

$$H \leftarrow H \cdot \frac{\langle V_{SP}/V_{SP}'^2,\ Q\circ W\rangle_{\{1,2\},\{1,2\}}}{\langle 1/V_{SP}',\ Q\circ W\rangle_{\{1,2\},\{1,2\}}} \tag{27}$$

Note that the calculation here is carried out on the premise that the frequency matrix W includes the main sound source frequency matrix $W_S$ as part thereof and thus, the elements other than the main sound source frequency matrix $W_S$ are exclusively updated during the update of the frequency matrix W illustrated in formula (26). Accordingly, a portion corresponding to the main sound source frequency matrix $W_S$ included in the frequency matrix W as an element is not updated while the frequency matrix W is updated.

Once the optimized channel matrix Q, the optimized frequency matrix W, and the optimized time matrix H are obtained through the above-described calculation, the main sound source separation unit 66 extracts elements corresponding to the main sound source and elements corresponding to the auxiliary sound source from these matrices to separate the picked up sound into the main sound source component and the auxiliary sound source component.

Specifically, the main sound source separation unit 66 sets an element other than the main sound source frequency matrix $W_S$ in the optimized frequency matrix W as an auxiliary sound source frequency matrix $W_N$.

The main sound source separation unit 66 also extracts an element corresponding to the main sound source frequency matrix $W_S$ from the optimized channel matrix Q as a main sound source channel matrix $Q_S$, while setting an element other than the main sound source channel matrix $Q_S$ in the optimized channel matrix Q as an auxiliary sound source channel matrix $Q_N$. The auxiliary sound source channel matrix $Q_N$ is a component of the auxiliary sound source.

Likewise, the main sound source separation unit 66 also extracts an element corresponding to the main sound source frequency matrix $W_S$ from the optimized time matrix H as a main sound source time matrix $H_S$, while setting an element other than the main sound source time matrix $H_S$ in the optimized time matrix H as an auxiliary sound source time matrix $H_N$. The auxiliary sound source time matrix $H_N$ is a component of the auxiliary sound source.

Here, the elements corresponding to the main sound source frequency matrix $W_S$ in the channel matrix Q and the time matrix H indicate elements of the basis spectrogram $V_p'$ including the element of the main sound source frequency matrix $W_S$, among the basis spectrograms $V_p'$ illustrated in the example in FIG. 4.

The main sound source separation unit 66 further extracts the main sound source from the group of the matrices obtained through the above-described processing using a Wiener filter.

Specifically, the main sound source separation unit 66 calculates following formula (28) to find respective elements of a basis spectrogram $V_S'$ of the main sound source on the basis of the respective elements of the main sound source channel matrix $Q_S$, the main sound source frequency matrix $W_S$, and the main sound source time matrix $H_S$.

[Mathematical Formula 28]

$$v'_{S\{jkl\}} = \sum_{p} q_{S\{jp\}} w_{S\{kp\}} h_{S\{lp\}} \tag{28}$$

Likewise, the main sound source separation unit 66 calculates following formula (29) to find respective elements of a basis spectrogram $V_N'$ of the auxiliary sound source on the basis of the respective elements of the auxiliary sound source channel matrix $Q_N$, the auxiliary sound source frequency matrix $W_N$, and the auxiliary sound source time matrix $H_N$.

[Mathematical Formula 29]

$$v'_{N[jkl]} = \sum_{p} q_{N[jp]} w_{N[kp]} h_{N[lp]} \tag{29}$$

On the basis of the basis spectrogram $V_S'$ of the main sound source and the basis spectrogram $V_N'$ of the auxiliary sound source that have been obtained, the main sound source separation unit 66 further calculates formula (30) and formula (31) below to work out a main sound source time-frequency spectrum $D_S$ ($n_{spk}$, $n_T$, l) and an auxiliary sound source time-frequency spectrum $D_N$ ($n_{spk}$, $n_T$, l). Note that, in formula (30) and formula (31), signs "·" represent multiplication for each element and division is calculated for each element.

[Mathematical Formula 30]

$$D_S(j, k, l) = \frac{V_S'}{V_S' + V_N'} \cdot D(j, k, l) \tag{30}$$

[Mathematical Formula 31]

$$D_N(j, k, l) = \frac{V_N'}{V_S' + V_N'} \cdot D(j, k, l) \tag{31}$$

In formula (30), the main sound source component within the time-frequency spectrum D ($n_{spk}$, $n_T$, l), namely, the time-frequency spectrum D (j, k, l) is solely extracted to be set as a main sound source time-frequency spectrum $D_S$ (j, k, l). Subsequently, the channel index j and the frequency index k in the main sound source time-frequency spectrum $D_S$ (j, k, l) are replaced with the original speaker index $n_{spk}$ and the original time-frequency spectrum index $n_T$, respectively, to be set as the main sound source time-frequency spectrum $D_S$ ($n_{spk}$, $n_T$, l).

Likewise, in formula (31), the auxiliary sound source component within the time-frequency spectrum D (j, k, l) is solely extracted to be set as an auxiliary sound source time-frequency spectrum $D_N$ (j, k, l). Subsequently, the channel index j and the frequency index k in the auxiliary sound source time-frequency spectrum $D_N$ (j, k, l) are replaced with the original speaker index $n_{spk}$ and the original time-frequency spectrum index $n_T$, respectively, to be set as the auxiliary sound source time-frequency spectrum $D_N$ ($n_{spk}$, $n_T$, l).

The main sound source separation unit 66 supplies the main sound source time-frequency spectrum $D_S$ ($n_{spk}$, $n_T$, l) and the auxiliary sound source time-frequency spectrum $D_N$ ($n_{spk}$, $n_T$, l) obtained through the above-described calculation to the main sound source emphasis unit 67.

In addition, the main sound source separation unit 86 also carries out processing similar to that of the main sound source separation unit 66 to supply, to the main sound source reduction unit 87, the main sound source time-frequency spectrum $D_S$ ($n_{spk}$, $n_T$, l) and the auxiliary sound source time-frequency spectrum $D_N$ ($n_{spk}$, $n_T$, l) obtained as a result thereof.

(Main Sound Source Emphasis Unit)

The main sound source emphasis unit 67 uses the main sound source time-frequency spectrum $D_S$ ($n_{spk}$, $n_T$, l) and the auxiliary sound source time-frequency spectrum $D_N$ ($n_{spk}$, $n_T$, l) supplied from the main sound source separation unit 66 to generate a main sound source-emphasized time-frequency spectrum $D_{ES}$ ($n_{spk}$, $n_T$, l).

Specifically, the main sound source emphasis unit 67 calculates following formula (32) to work out the main sound source-emphasized time-frequency spectrum $D_{ES}$ ($n_{spk}$, $n_T$, l) in which components of the main sound source time-frequency spectrum $D_S$ ($n_{spk}$, $n_T$, l) within the time-frequency spectrum D ($n_{spk}$, $n_T$, l) are emphasized.

[Mathematical Formula 32]

$$D_{ES}(n_{spk}, n_T, l) = \alpha D_S(n_{spk}, n_T, l) + D_N(n_{spk}, n_T, l) \tag{32}$$

Note that, in formula (32), α represents a weight coefficient indicating the degree of emphasis of the main sound source time-frequency spectrum $D_S$ ($n_{spk}$, $n_T$, l), where the weight coefficient α is set to a coefficient larger than 1.0. Accordingly, in formula (32), the main sound source time-frequency spectrum is weighted with the weight coefficient α and then added to the auxiliary sound source time-frequency spectrum, whereby the main sound source-emphasized time-frequency spectrum is obtained. Namely, weighting addition is carried out.

The main sound source emphasis unit 67 supplies the main sound source-emphasized time-frequency spectrum $D_{ES}$ ($n_{spk}$, $n_T$, l) obtained through the calculation of formula (32) to the time-frequency synthesizer 68.

(Main Sound Source Reduction Unit)

The main sound source reduction unit 87 uses the main sound source time-frequency spectrum $D_S$ ($n_{spk}$, $n_T$, l) and the auxiliary sound source time-frequency spectrum $D_N$ ($n_{spk}$, $n_T$, l) supplied from the main sound source separation unit 86 to generate a main sound source-reduced time-frequency spectrum $D_{EN}$ ($n_{spk}$, $n_T$, l).

Specifically, the main sound source reduction unit 87 calculates following formula (33) to work out the main sound source-reduced time-frequency spectrum $D_{EN}$ ($n_{spk}$, $n_T$, l) in which components of the auxiliary sound source time-frequency spectrum $D_N$ ($n_{spk}$, $n_T$, l) within the time-frequency spectrum D ($n_{spk}$, $n_T$, l) are emphasized.

[Mathematical Formula 33]

$$D_{EN}(n_{spk}, n_T, l) = D_S(n_{spk}, n_T, l) + \alpha D_N(n_{spk}, n_T, l) \tag{33}$$

Note that, in formula (33), α represents a weight coefficient indicating the degree of emphasis of the auxiliary sound source time-frequency spectrum $D_N$ ($n_{spk}$, $n_T$, l), where the weight coefficient α is set to a coefficient larger than 1.0. Note that, the weight coefficient α in formula (33) may be a value similar to that of the weight coefficient α in formula (32), or alternatively, may be a value different therefrom.

In formula (33), the auxiliary sound source time-frequency spectrum is weighted with the weight coefficient α and then added to the main sound source time-frequency spectrum, whereby the main sound source-reduced time-frequency spectrum is obtained. Namely, weighting addition is carried out to emphasize the auxiliary sound source time-frequency spectrum and consequently, the main sound source time-frequency spectrum is relatively reduced.

The main sound source reduction unit 87 supplies the main sound source-reduced time-frequency spectrum $D_{EN}$ ($n_{spk}$, $n_T$, l) obtained through the calculation of formula (33) to the time-frequency synthesizer 88.

(Time-Frequency Synthesizer)

The time-frequency synthesizer 68 calculates following formula (34) to carry out the time-frequency synthesis of the main sound source-emphasized time-frequency spectrum $D_{ES}$ ($n_{spk}$, $n_T$, l) supplied from the main sound source emphasis unit 67 to obtain an output frame signal $d_{fr}$ ($n_{spk}$, $n_{fr}$, l). Although inverse short time Fourier transform (ISTFT) is used here as the time-frequency synthesis, any equivalent to the inverse conversion of the time-frequency conversion (forward conversion) carried out at the time-frequency analyzer 61 can be employed.

[Mathematical Formula 34]

$$d_{fr}(n_{spk}, n_{fr}, l) = \frac{1}{M_T}\sum_{m_T=0}^{M_T-1} D'(n_{spk}, m_T, l)\exp\left(i2\pi\frac{n_{fr}m_T}{M_T}\right) \tag{34}$$

Note that, D' ($n_{spk}$, $m_T$, l) in formula (34) is obtained using following formula (35).

[Mathematical Formula 35]

$$D'(n_{spk}, m_T, l) = \begin{cases} D_{ES}(n_{spk}, m_T, l) & m_T = 0, \ldots, N_T - 1 \\ conj(D_{ES}(n_{spk}, M_T - m_T, l) & m_T = N_T, \ldots, M_T - 1 \end{cases} \tag{35}$$

In formula (34), i represents the pure imaginary number and $n_{fr}$ represents the time index. In addition, in formula (34) and formula (35), $M_T$ represents the number of points for the ISTFT and $n_{spk}$ represents the speaker index.

Furthermore, the time-frequency synthesizer 68 multiplies the obtained output frame signal $d_{fr}$ ($n_{spk}$, $n_{fr}$, l) by the window function $w_T$ ($n_{fr}$) and carries out overlap addition to carry out frame synthesis. For example, the frame synthesis is carried out through the calculation of following formula (36), whereby an output signal d ($n_{spk}$,t) is found.

[Mathematical Formula 36]

$$d^{curr}(n_{spk}, n_{fr}+l\,N_{fr}) = d_{fr}(n_{spk}, n_{fr}, l)w_T(n_{fr}) + d^{prev}(n_{spk}, n_{fr}+l\,N_{fr}) \tag{36}$$

Note that, the window function similar to that used at the time-frequency analyzer 61 is used here as the window function $w_T(n_{fr})$ by which the output frame signal $d_{fr}(n_{spk}, n_{fr}, l)$ is multiplied. However, a rectangular window can be employed in the case of another window such as the Hamming window.

In addition, in formula (36), $d^{prev}$ ($n_{spk}$, $n_{fr}$, l $N_{fr}$) and $d^{curr}$ ($n_{spk}$, $n_{fr}$+l $N_{fr}$) both represent the output signal d ($n_{spk}$, t), where $d^{prev}$ ($n_{spk}$, $n_{fr}$+l $N_{fr}$) represents a value before the update, whereas $d^{curr}$ ($n_{spk}$, $n_{fr}$+l $N_{fr}$) represents a value after the update.

The time-frequency synthesizer 68 supplies the output signal d ($n_{spk}$, t) obtained as described above to the speaker array 26-1 as the speaker drive signal.

In addition, by carrying out processing similar to that of the time-frequency synthesizer 68, the time-frequency synthesizer 88 also generates the speaker drive signal on the basis of the main sound source-reduced time-frequency spectrum $D_{EN}$ ($n_{spk}$, $n_T$, l) supplied from the main sound source reduction unit 87, to supply to the speaker array 26-2.

<Description of Sound Field Reproduction Processing>

Next, a flow of the above-described processing carried out by the main sound source-emphasizing sound field reproduction unit 11 will be described. Upon being instructed to pick up a sound on a wave surface with respect to the sound in the sound pickup space, the main sound source-emphasizing sound field reproduction unit 11 carries out the sound field reproduction processing in which the sound on that wave surface is picked up and the sound field is reproduced.

Figure 5:
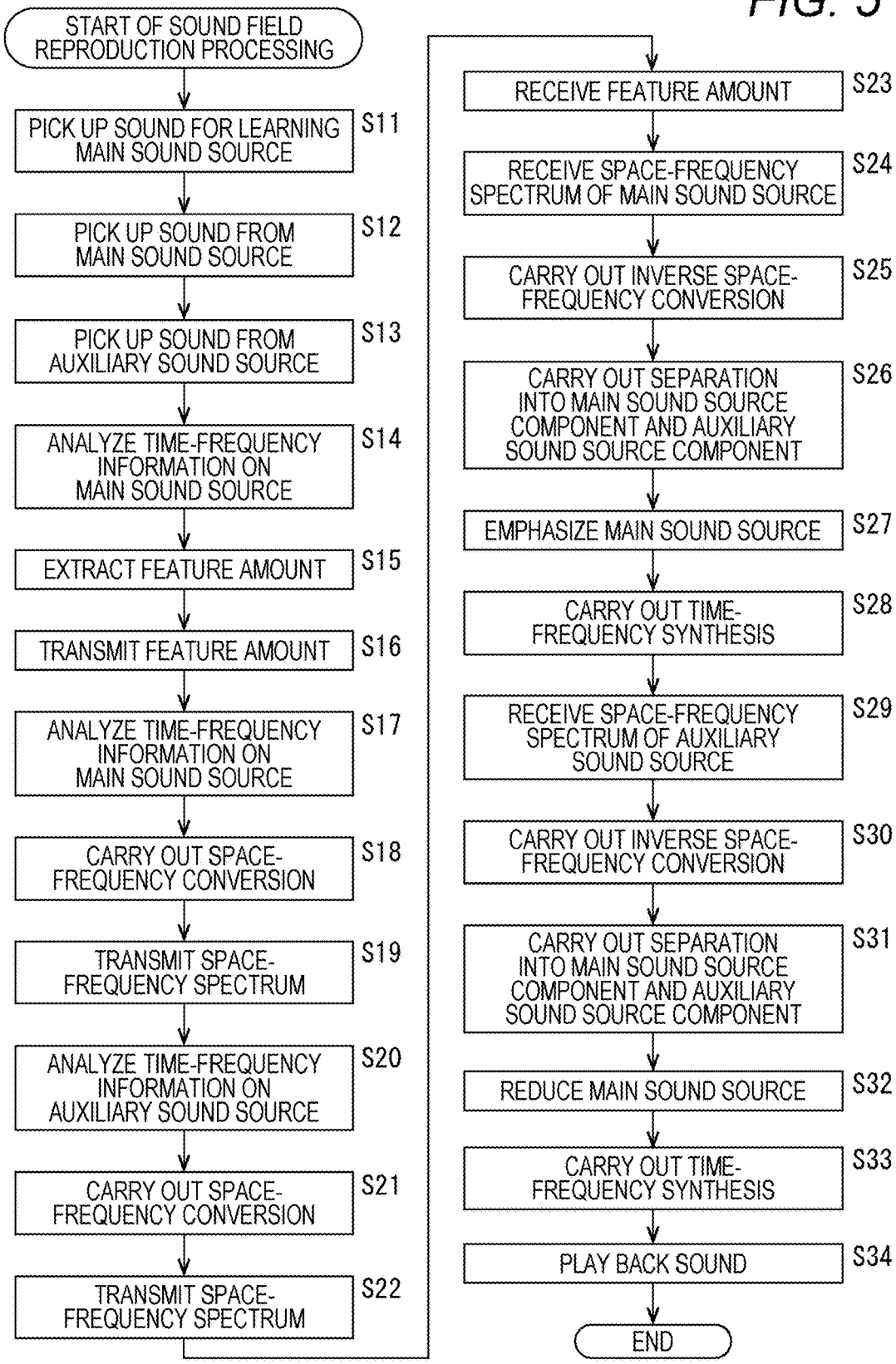
FIG. 5 is a flowchart for describing sound field reproduction processing.

Hereinafter, the sound field reproduction processing by the main sound source-emphasizing sound field reproduction unit 11 will be described with reference to a flowchart in FIG. 5.

At step S11, the microphone 21 picks up the sound from the main sound source, that is, the sound for learning the main sound source in the sound pickup space and supplies the sound pickup signal obtained as a result thereof to the time-frequency analyzer 41.

At step S12, the microphone array 23-1 picks up the sound from the main sound source in the sound pickup space and supplies the sound pickup signal obtained as a result thereof to the time-frequency analyzer 61.

At step S13, the microphone array 23-2 picks up the sound from the auxiliary sound source in the sound pickup space and supplies the sound pickup signal obtained as a result thereof to the time-frequency analyzer 81.

Note that, in more detail, processing at step S11 to step S13 is simultaneously carried out.

At step S14, the time-frequency analyzer 41 analyzes the time-frequency information in the sound pickup signal supplied from the microphone 21, that is, the time-frequency information on the main sound source.

Specifically, the time-frequency analyzer 41 carries out the time frame division on the sound pickup signal and multiplies the input frame signal obtained as a result thereof by the window function to work out the window function-applied signal.

The time-frequency analyzer 41 also carries out the time-frequency conversion on the window function-applied signal and supplies the time-frequency spectrum obtained as a result thereof to the feature amount extraction unit 42. Specifically, formula (4) is calculated and the time-frequency spectrum S ($n_{mic}$, $n_T$, l) is worked out.

At step S15, the feature amount extraction unit 42 extracts the main sound source feature amount on the basis of the time-frequency spectrum supplied from the time-frequency analyzer 41.

Specifically, by calculating formula (5) and at the same time calculating formula (16) to formula (18), the feature amount extraction unit 42 optimizes the channel matrix Q, the frequency matrix W, and the time matrix H and supplies, to the communication unit 43, the main sound source frequency matrix $W_S$ obtained through the optimization as the main sound source feature amount.

At step S16, the communication unit 43 transmits the main sound source feature amount supplied from the feature amount extraction unit 42.

At step S17, the time-frequency analyzer 61 analyzes the time-frequency information in the sound pickup signal supplied from the microphone array 23-1, that is, the time-frequency information on the main sound source and supplies the time-frequency spectrum obtained as a result thereof to the space-frequency analyzer 62. At step S17, processing similar to that at step S14 is carried out.

At step S18, the space-frequency analyzer 62 carries out the space-frequency conversion on the time-frequency spectrum supplied from the time-frequency analyzer 61 and supplies the space-frequency spectrum obtained as a result thereof to the communication unit 63. Specifically, formula (20) is calculated at step S18.

At step S19, the communication unit 63 transmits the space-frequency spectrum supplied from the space-frequency analyzer 62.

At step S20, the time-frequency analyzer 81 analyzes the time-frequency information in the sound pickup signal supplied from the microphone array 23-2, that is, the time-frequency information on the auxiliary sound source and supplies the time-frequency spectrum obtained as a result thereof to the space-frequency analyzer 82. At step S20, processing similar to that at step S14 is carried out.

At step S21, the space-frequency analyzer 82 carries out the space-frequency conversion on the time-frequency spectrum supplied from the time-frequency analyzer 81 and supplies the space-frequency spectrum obtained as a result thereof to the communication unit 83. Specifically, formula (20) is calculated at step S21.

At step S22, the communication unit 83 transmits the space-frequency spectrum supplied from the space-frequency analyzer 82.

At step S23, the communication unit 44 receives the main sound source feature amount transmitted from the communication unit 43 to supply to the main sound source separation unit 66 and the main sound source separation unit 86.

At step S24, the communication unit 64 receives the space-frequency spectrum of the main sound source transmitted from the communication unit 63 to supply to the space-frequency synthesizer 65.

At step S25, the space-frequency synthesizer 65 finds the drive signal in the spatial region on the basis of the space-frequency spectrum supplied from the communication unit 64 and then carries out the inverse space-frequency conversion on that drive signal to supply the time-frequency spectrum obtained as a result thereof to the main sound source separation unit 66.

Specifically, the space-frequency synthesizer 65 calculates aforementioned formula (21) to find the drive signal in the spatial region and additionally calculates formula (23) to work out the time-frequency spectrum $D(n_{spk}, n_T, l)$.

At step S26, on the basis of the main sound source feature amount supplied from the communication unit 44, the main sound source separation unit 66 separates the time-frequency spectrum supplied from the space-frequency synthesizer 65 into the main sound source component and the auxiliary sound source component to supply to the main sound source emphasis unit 67.

Specifically, the main sound source separation unit 66 calculates formula (24) to formula (31) and then works out the main sound source time-frequency spectrum $D_S(n_{spk}, n_T, l)$ and the auxiliary sound source time-frequency spectrum $D_N(n_{spk}, n_T, l)$ to supply to the main sound source emphasis unit 67.

At step S27, the main sound source emphasis unit 67 calculates formula (32) on the basis of the main sound source time-frequency spectrum and the auxiliary sound source time-frequency spectrum supplied from the main sound source separation unit 66 to emphasize the main sound source components and supplies the main sound source-emphasized time-frequency spectrum obtained as a result thereof to the time-frequency synthesizer 68.

At step S28, the time-frequency synthesizer 68 carries out the time-frequency synthesis of the main sound source-emphasized time-frequency spectrum supplied from the main sound source emphasis unit 67.

Specifically, the time-frequency synthesizer 68 calculates formula (34) to work out the output frame signal from the main sound source-emphasized time-frequency spectrum. Additionally, the time-frequency synthesizer 68 multiplies the output frame signal by the window function to calculate formula (36) and works out the output signal through the frame synthesis. The time-frequency synthesizer 68 supplies the output signal obtained as described above to the speaker array 26-1 as the speaker drive signal.

At step S29, the communication unit 84 receives the space-frequency spectrum of the auxiliary sound source transmitted from the communication unit 83 to supply to the space-frequency synthesizer 85.

At step S30, the space-frequency synthesizer 85 finds the drive signal in the spatial region on the basis of the space-frequency spectrum supplied from the communication unit 84 and then carries out the inverse space-frequency conversion on that drive signal to supply the time-frequency spectrum obtained as a result thereof to the main sound source separation unit 86. Specifically, processing similar to that at step S25 is carried out at step S30.

At step S31, on the basis of the main sound source feature amount supplied from the communication unit 44, the main sound source separation unit 86 separates the time-frequency spectrum supplied from the space-frequency synthesizer 85 into the main sound source component and the auxiliary sound source component to supply to the main sound source reduction unit 87. At step S31, processing similar to that at step S26 is carried out.

At step S32, the main sound source reduction unit 87 calculates formula (33) on the basis of the main sound source time-frequency spectrum and the auxiliary sound source time-frequency spectrum supplied from the main sound source separation unit 86 to reduce the main sound source components and supplies the main sound source-reduced time-frequency spectrum obtained as a result thereof to the time-frequency synthesizer 88.

At step S33, the time-frequency synthesizer 88 carries out the time-frequency synthesis of the main sound source-reduced time-frequency spectrum supplied from the main sound source reduction unit 87 and supplies the output signal obtained as a result thereof to the speaker array 26-2 as the speaker drive signal. At step S33, processing similar to that at step S28 is carried out.

At step S34, the speaker array 26 plays back the sound. Specifically, the speaker array 26-1 plays back the sound on the basis of the speaker drive signal supplied from the time-frequency synthesizer 68. As a result, the sound of the main sound source is output from the speaker array 26-1.

Additionally, the speaker array 26-2 plays back the sound on the basis of the speaker drive signal supplied from the time-frequency synthesizer 88. As a result, the sound of the auxiliary sound source is output from the speaker array 26-2.

When the sounds of the main sound source and the auxiliary sound source are output as described above, the sound field in the sound pickup space is reproduced in the reproduction space. The sound field reproduction processing is completed when the sound field in the sound pickup space is reproduced.

In a manner as described thus far, the main sound source-emphasizing sound field reproduction unit 11 uses the main sound source feature amount to separate the time-frequency spectrum obtained by picking up the sound into the main sound source component and the auxiliary sound source component. Subsequently, the main sound source-emphasizing sound field reproduction unit 11 emphasizes the main sound source components of the time-frequency spectrum obtained by mainly picking up the sound from the main sound source to generate the speaker drive signal and at the same time reduces the main sound source components of the time-frequency spectrum obtained by mainly picking up the sound from the auxiliary sound source to generate the speaker drive signal.

As described thus far, the main sound source components are properly emphasized, while the main sound source components are properly reduced when the speaker drive signals for the speaker arrays 26 are generated, whereby a certain sound field in the sound pickup space can be further accurately reproduced through simple processing.

First Variation of First Embodiment

<Exemplary Configuration of Main Sound Source-Emphasizing Sound Field Reproduction Unit>

Note that, the description above has used an example where one microphone array 23 is used as each of the main sound source linear microphone array and the auxiliary sound source linear microphone array. However, the plurality of microphone arrays may be used as the main sound source linear microphone array or the auxiliary sound source linear microphone array.

Figure 6:
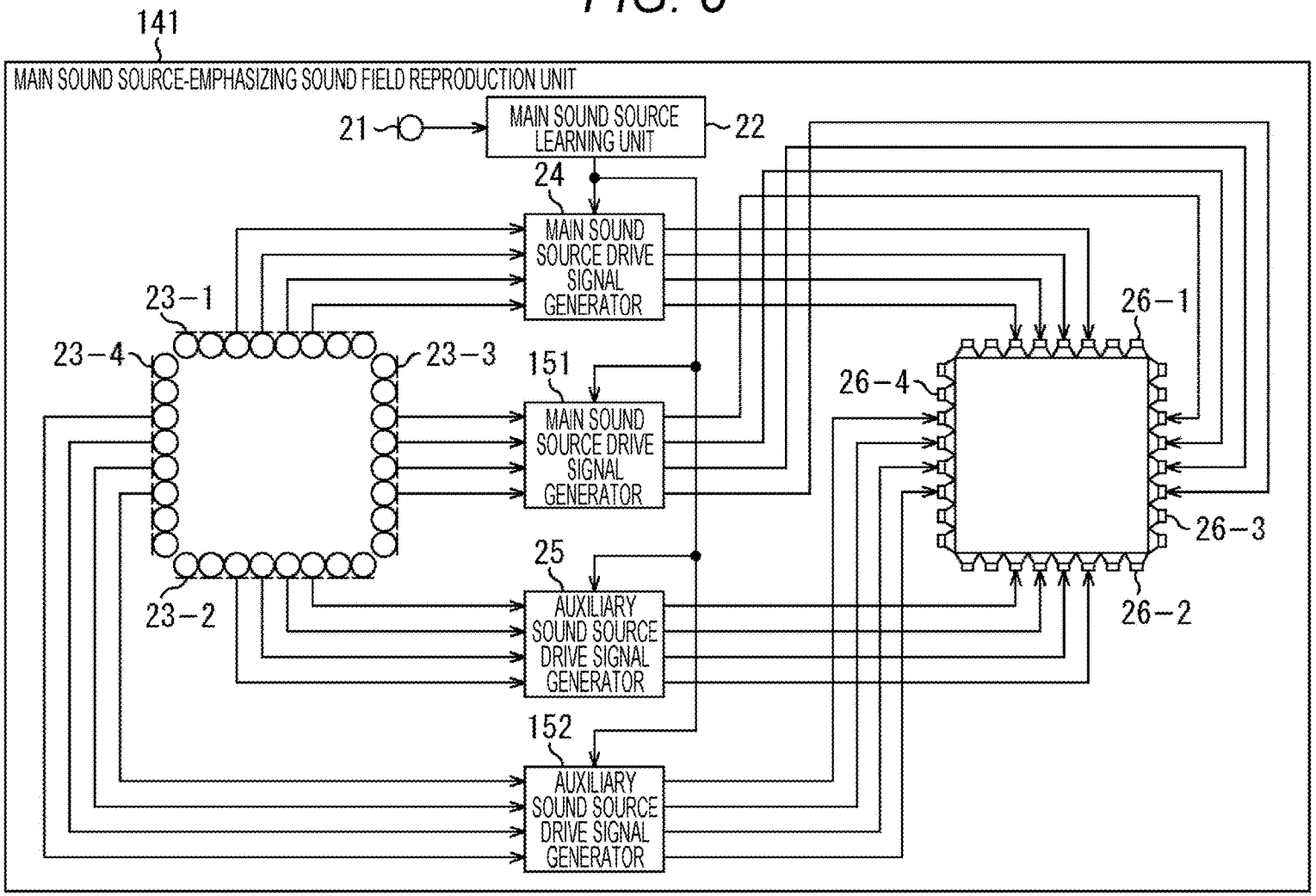
FIG. 6 is a diagram illustrating another exemplary configuration of the main sound source-emphasizing sound field reproduction unit.

In such a case, the main sound source-emphasizing sound field reproduction unit is configured, for example, as illustrated in FIG. 6. Note that, in FIG. 6, constituent members corresponding to those in the case of FIG. 3 are denoted with the same reference numerals and the description thereof will be omitted as appropriate.

A main sound source-emphasizing sound field reproduction unit 141 illustrated in FIG. 6 is constituted by a microphone 21, a main sound source learning unit 22, a microphone array 23-1 to a microphone array 23-4, a main sound source drive signal generator 24, a main sound source drive signal generator 151, an auxiliary sound source drive signal generator 25, an auxiliary sound source drive signal generator 152, and a speaker array 26-1 to a speaker array 26-4.

In this example, the four microphone arrays, namely, the microphone array 23-1 to the microphone array 23-4 are arranged in a square shape in the sound pickup space. In addition, the two microphone arrays, namely, the microphone array 23-1 and the microphone array 23-3 are used as the main sound source linear microphone arrays, whereas the remaining two microphone arrays, namely, the microphone array 23-2 and the microphone array 23-4 are used as the auxiliary sound source linear microphone arrays.

Meanwhile, the speaker array 26-1 to the speaker array 26-4 corresponding to these microphone arrays 23-1 to 23-4, respectively, are arranged in a square shape in the reproduction space.

As in the case of FIG. 3, by using the main sound source feature amount supplied from the main sound source learning unit 22, the main sound source drive signal generator 24 generates, from the sound pickup signal supplied from the microphone array 23-1, the speaker drive signal for mainly playing back the sound from the main sound source to supply to the speaker array 26-1.

A configuration similar to that of the main sound source drive signal generator 24 illustrated in FIG. 3 is set for the main sound source drive signal generator 151. By using the main sound source feature amount supplied from the main sound source learning unit 22, the main sound source drive signal generator 151 generates, from the sound pickup signal supplied from the microphone array 23-3, the speaker drive signal for mainly playing back the sound from the main sound source to supply to the speaker array 26-3. Accordingly, the sound from the main sound source is reproduced in the speaker array 26-3 on the basis of the speaker drive signal.

Meanwhile, as in the case of FIG. 3, by using the main sound source feature amount supplied from the main sound source learning unit 22, the auxiliary sound source drive signal generator 25 generates, from the sound pickup signal supplied from the microphone array 23-2, the speaker drive signal for mainly playing back the sound from the auxiliary sound source to supply to the speaker array 26-2.

A configuration similar to that of the auxiliary sound source drive signal generator 25 illustrated in FIG. 3 is set for the auxiliary sound source drive signal generator 152. By using the main sound source feature amount supplied from the main sound source learning unit 22, the auxiliary sound source drive signal generator 152 generates, from the sound pickup signal supplied from the microphone array 23-4, the speaker drive signal for mainly playing back the sound from the auxiliary sound source to supply to the speaker array 26-4. Accordingly, the sound from the auxiliary sound source is reproduced in the speaker array 26-4 on the basis of the speaker drive signal.

Incidentally, a series of the above-described processing can be carried out by hardware as well and also can be carried out by software. When the series of the processing is carried out by software, a program constituting the software is installed in a computer. Here, the computer includes a computer built into dedicated hardware and a computer capable of executing various types of functions when installed with various types of programs, for example, a general-purpose computer.

Figure 7:
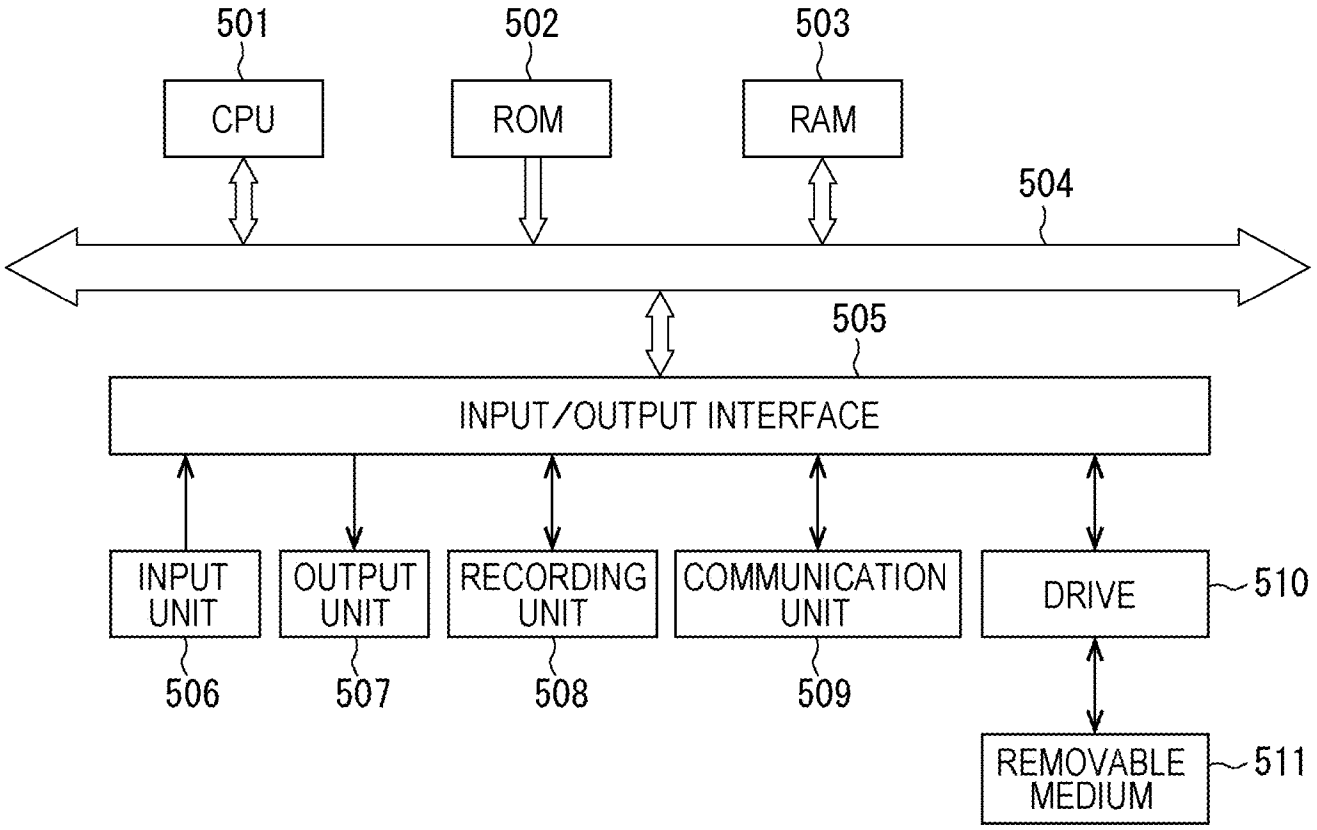
FIG. 7 is a diagram illustrating an exemplary configuration of a computer.

FIG. 7 is a block diagram illustrating an exemplary hardware configuration of a computer that carries out the aforementioned series of the processing using a program.

In the computer, a central processing unit (CPU) 501, a read only memory (ROM) 502, and a random access memory (RAM) 503 are interconnected through a bus 504.

Additionally, an input/output interface 505 is connected to the bus 504. An input unit 506, an output unit 507, a recording unit 508, a communication unit 509, and a drive 510 are connected to the input/output interface 505.

The input unit 506 includes a keyboard, a mouse, a microphone, and an image pickup element. The output unit 507 includes a display and a speaker. The recording unit 508 includes a hard disk and a non-volatile memory. The communication unit 509 includes a network interface. The drive 510 drives a removable medium 511 such as a magnetic disk, an optical disc, a magneto-optical disk, or a semiconductor memory.

In the computer configured as described above, for example, the aforementioned series of the processing is carried out in such a manner that the CPU 501 loads a program recorded in the recording unit 508 to the RAM 503 through the input/output interface 505 and the bus 504 to execute.

For example, the program executed by the computer (CPU 501) can be provided by being recorded in the removable medium 511 serving as a package medium or the like. In addition, the program can be provided through a wired or wireless transmission medium such as a local area network, the Internet, or digital satellite broadcasting.

In the computer, the program can be installed to the recording unit 508 through the input/output interface 505 by mounting the removable medium 511 in the drive 510. The program can be also installed to the recording unit 508 through a wired or wireless transmission medium when received by the communication unit 509. As an alternative manner, the program can be installed to the ROM 502 or the recording unit 508 in advance.

Note that, the program executed by the computer may be a program in which the processing is carried out along the time series in accordance with the order described in the present description, or alternatively, may be a program in which the processing is carried out in parallel or at a necessary timing, for example, when called.

In addition, the embodiments according to the present technique are not limited to the aforementioned embodiments and various modifications can be made without departing from the scope of the present technique.

For example, the present technique can employ a cloud computing configuration in which one function is divided and allocated to a plurality of devices so as to be processed in coordination thereamong through a network.

In addition, the respective steps described in the aforementioned flowchart can be carried out by a plurality of devices each taking a share thereof as well as carried out by a single device.

Furthermore, when a plurality of processing is included in one step, that plurality of processing included in one step can be carried out by a plurality of devices each taking a share thereof as well as carried out by a single device.

In addition, the effects described in the present description merely serve as examples and not construed to be limited. There may be another effect.

Additionally, the present technique can be configured as described below.

(1)

A sound field reproduction device including an emphasis unit that emphasizes main sound source components of a first sound pickup signal obtained by picking up a sound using a first microphone array positioned ahead of a main sound source, on the basis of a feature amount extracted from a signal obtained by picking up a sound from the main sound source using a sound pickup unit.

(2)

The sound field reproduction device according to (1) further including a reduction unit that reduces the main sound source components of a second sound pickup signal obtained by picking up a sound using a second microphone array positioned ahead of an auxiliary sound source, on the basis of the feature amount.

(3)

The sound field reproduction device according to (2), in which the emphasis unit separates the first sound pickup signal into the main sound source component and an auxiliary sound source component on the basis of the feature amount and emphasizes the separated main sound source components.

(4)

The sound field reproduction device according to (3), in which the reduction unit separates the second sound pickup signal into the main sound source component and the auxiliary sound source component on the basis of the feature amount and emphasizes the separated auxiliary sound source components to reduce the main sound source components of the second sound pickup signal.

(5)

The sound field reproduction device according to (3) or (4), in which the emphasis unit separates the first sound pickup signal into the main sound source component and the auxiliary sound source component using nonnegative tensor factorization.

(6)

The sound field reproduction device according to (4) or (5), in which the reduction unit separates the second sound pickup signal into the main sound source component and the auxiliary sound source component using the nonnegative tensor factorization.

(7)

The sound field reproduction device according to any one of (1) to (6), further including the plurality of emphasis units, each of which corresponds to each of the plurality of first microphone arrays.

(8)

The sound field reproduction device according to any one of (2) to (6), further including the plurality of reduction units, each of which corresponds to each of the plurality of second microphone arrays.

(9)

The sound field reproduction device according to any one of (2) to (6), in which the first microphone array is arranged on a straight line connecting a space enclosed by the first microphone array and the second microphone array and the main sound source.

(10)

The sound field reproduction device according to any one of (1) to (9), in which the sound pickup unit is arranged in the vicinity of the main sound source.

(11)

A sound field reproduction method including a step of emphasizing main sound source components of a first sound pickup signal obtained by picking up a sound using a first microphone array positioned ahead of a main sound source, on the basis of a feature amount extracted from a signal obtained by picking up a sound from the main sound source using a sound pickup unit.

(12)

A program that causes a computer to carry out processing including a step of emphasizing main sound source components of a first sound pickup signal obtained by picking up a sound using a first microphone array positioned ahead of a main sound source, on the basis of a feature amount extracted from a signal obtained by picking up a sound from the main sound source using a sound pickup unit.

REFERENCE SIGNS LIST

11 Main sound source-emphasizing sound field reproduction unit
42 Feature amount extraction unit
66 Main sound source separation unit
67 Main sound source emphasis unit
86 Main sound source separation unit
87 Main sound source reduction unit

The invention claimed is:

1. A sound field reproduction device comprising:

at least one memory storing instructions; and at least one processor, programmed via the instructions to:

receive a first signal obtained by a first microphone array, the first microphone array positioned ahead of a main sound source, wherein the first signal comprises a plurality of components including a main sound source component generated by the main sound source;

receive a second signal obtained by a sound pickup unit from the main sound source;

identify a feature of sound generated by the main sound source using the second signal obtained by the sound pickup unit, the feature of sound comprising a representation of a pattern of the sound generated by the main sound source;

identify the main sound source component of the first signal obtained by the first microphone array at least in part by separating, using the identified feature of the sound generated by the main sound source, the main sound source component of the first signal from one or more of the plurality of components of the first signal different from the main sound source component, the separating comprising extracting the main sound source component from the first signal based on the representation of the pattern of the sound generated by the main sound source; and emphasize the identified main sound source component of the first signal obtained by the first microphone array.

2. A sound field reproduction device comprising:

at least one memory storing instructions; and at least one processor, programmed via the instructions to:

receive a first signal obtained by a first microphone array, the first microphone array positioned ahead of a main sound source, wherein the first signal comprises a plurality of components including a main sound source component generated by the main sound source;

receive a second signal obtained by a sound pickup unit from the main sound source;

identify a feature of sound generated by the main sound source using the second signal obtained by the sound pickup unit;

identify the main sound source component of the first signal obtained by the first microphone array using the identified feature of the sound generated by the main sound source; and receive a third signal from a second microphone array, the second microphone array positioned ahead of an auxiliary sound source, wherein the third signal comprises a plurality of components including a main sound source component generated by the main sound source;

identify the main sound source component of the third signal using the identified feature of the sound generated by the main sound source;

emphasize the identified main sound source component of the first signal obtained by the first microphone array; and reduce the main sound source component of the third signal obtained by the second microphone array.

3. The sound field reproduction device according to claim 2, wherein the wherein the at least one processor is further programmed via the instructions to:

separate the first signal into a first main sound component and a first auxiliary sound component based at least on the identified feature of the sound generated by the main sound source; and emphasize the separated first main sound source component of the first signal.

4. The sound field reproduction device according to claim 3, wherein the at least one processor is further programmed via the instructions to:

separate the third signal into a second main sound source component and a second auxiliary sound source component based at least on the identified feature of the sound generated by the main sound source; and emphasize the separated second auxiliary sound source component to reduce the second main sound source component.

5. The sound field reproduction device according to claim 3, wherein the at least one processor is further programmed via the instructions to separate the first signal using non-negative tensor factorization.

6. The sound field reproduction device according to claim 4, wherein the at least one processor is further programmed via the instructions to separate the third signal using non-negative tensor factorization.

7. The sound field reproduction device according to claim 1, wherein the at least one processor is programmed via the instructions to emphasize main sound source components of a plurality of signals obtained by a plurality of first microphone arrays.

8. The sound field reproduction device according to claim 2, wherein the at least one processor is programmed via the instructions to reduce main sound source components of a plurality of signals obtained by a plurality of second microphone arrays.

9. The sound field reproduction device according to claim 2, wherein the first microphone array is arranged on a straight line connecting a space enclosed by the first microphone array, the second microphone array, and the main sound source.

10. The sound field reproduction device according to claim 1, wherein the sound pickup unit is arranged in a vicinity of the main sound source.

11. A sound field reproduction method comprising:

receiving a first signal obtained by a first microphone array, the first microphone array positioned ahead of a main sound source, wherein the first signal comprises a plurality of components including a main sound source component generated by the main sound source;

receiving a second signal obtained by a sound pickup unit from the main sound source;

identifying a feature of sound generated by the main sound source using the second signal obtained by the sound pickup unit, the feature of sound comprising a representation of a pattern of the sound generated by the main sound source;

identifying the main sound source component of the first signal obtained by the first microphone array at least in part by separating, using the identified feature of the sound generated by the main sound source, the main sound source component of the first signal from one or more of the plurality of components of the first signal different from the main sound source component, the separating comprising extracting the main sound source component from the first signal based on the representation of the pattern of the sound generated by the main sound source; and emphasizing the identified main sound source component of the first signal obtained by the first microphone array.

12. At least one non-transitory computer-readable medium storing instructions, which when executed by at least one computer, cause the at least one computer to perform a method comprising:

receiving a first signal obtained by a first microphone array, the first microphone array positioned ahead of a main sound source, wherein the first signal comprises a plurality of components including a main sound source component generated by the main sound source;

receiving a second signal obtained by a sound pickup unit from the main sound source;

identifying a feature of sound generated by the main sound source using the second signal obtained by the sound pickup unit, the feature of sound comprising a representation of a pattern of the sound generated by the main sound source;

identifying the main sound source component of the first signal obtained by the first microphone array at least in part by separating, using the identified feature of the sound generated by the main sound source, the main sound source component of the first signal from one or more of the plurality of components of the first signal different from the main sound source component, the separating comprising extracting the main sound source component from the first signal based on the representation of the pattern of the sound generated by the main sound source; and emphasizing the identified main sound source component of the first signal obtained by the first microphone array.

13. The device of claim 1, wherein the representation of the pattern of the sound generated by the main sound source comprises a representation of a frequency distribution of the sound generated by the main sound source.

* * * * *